US005881569A

United States Patent [19]

Campbell et al.

[11] Patent Number: 5,881,569

[45] **Date of Patent: *Mar. 16, 1999**

[54] HYDROCARBON GAS PROCESSING

[75] Inventors: Roy E. Campbell, deceased, late of Midland, by Wanda P. Campbell, executor; John D. Wilkinson, Midland; Hank M. Hudson, Midland; Kyle T. Cueller, Midland, all of Tex.

[73] Assignee: Elcor Corporation, Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 915,065

[22] Filed: Aug. 20, 1997

Related U.S. Application Data

[60] Provisional application No. 60/045,874 May 7, 1997.

[51] Int. Cl.[6] ..... F25J 3/02

[52] U.S. Cl. ..... 62/621; 62/630; 62/935

[58] Field of Search ..... 62/621, 630, 935

[56] References Cited

U.S. PATENT DOCUMENTS

| | | | |
|---|---|---|---|
| 2,880,592 | 4/1959 | Davidson et al. | 62/621 |
| 4,157,904 | 6/1979 | Campbell et al. . | |
| 4,171,964 | 10/1979 | Campbell et al. . | |
| 4,278,457 | 7/1981 | Campbell et al. . | |
| 4,519,824 | 5/1985 | Huebel . | |
| 4,657,571 | 4/1987 | Gazzi . | |
| 4,687,499 | 8/1987 | Aghili | 62/621 |
| 4,710,214 | 12/1987 | Sharma | 62/621 |
| 4,854,955 | 8/1989 | Campbell et al. . | |
| 4,869,740 | 9/1989 | Campbell et al. . | |
| 4,889,545 | 12/1989 | Campbell et al. . | |
| 5,275,005 | 11/1994 | Campbell et al. | 62/621 |
| 5,555,748 | 9/1996 | Campbell et al. . | |
| 5,568,737 | 10/1996 | Campbell et al. . | |
| 5,685,170 | 11/1997 | Sorensen . | |

FOREIGN PATENT DOCUMENTS

| | | |
|---|---|---|
| 2102931 | 6/1982 | United Kingdom . |

*Primary Examiner*—Ronald C. Capossela
*Attorney, Agent, or Firm*—Baker & Botts, L.L.P.

[57] ABSTRACT

A process for the recovery of ethane, ethylene, propane, propylene and heavier hydrocarbon components from a hydrocarbon gas stream is disclosed. The stream is divided into first and second streams, and the second stream is expanded to the fractionation tower pressure and supplied to the column at a mid-column feed position. A recycle stream is withdrawn from the tower overhead after it has been warmed and compressed, and is combined with the first stream. The combined stream is cooled to condense substantially all of it, and is thereafter expanded to the fractionation tower pressure and supplied to the fractionation tower at a top column feed position. The pressure of the compressed recycle stream and the quantities and temperatures of the feeds to the column are effective to maintain the column overhead temperature at a temperature whereby the major portion of the desired components is recovered.

67 Claims, 17 Drawing Sheets

HYDROCARBON GAS PROCESSING

BACKGROUND OF THE INVENTION

This invention relates to a process for the separation of a gas containing hydrocarbons. The applicants claim the benefits under Title 35, United States Code, Section 119(e) of prior U.S. Provisional application Ser. No. 60/045,874 which was filed on May 7, 1997.

Ethylene, ethane, propylene, propane and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane and heavier hydrocarbons from such gas streams. A typical analysis of a gas stream to be processed in accordance with this invention would be, in approximate mole percent, 67.0% methane, 15.6% ethane and other $C_2$ components, 7.7% propane and other $C_3$ components, 1.8% iso-butane, 1.7% normal butane, 1.0% pentanes plus, 2.2% carbon dioxide, with the balance made up of nitrogen. Sulfur containing gases are also sometimes present.

The historically cyclic fluctuations in the prices of both natural gas and its natural gas liquid (NGL) constituents have at times reduced the incremental value of ethane, ethylene, and heavier components as liquid products. This has resulted in a demand for processes that can provide more efficient recoveries of these products, and for processes that can provide efficient recoveries with lower capital investment. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of start up, operating flexibility, good efficiency, safety, and good reliability. U.S. Pat. Nos. 4,157,904, 4,171,964, 4,278,457, 4,519,824, 4,687,499, 4,854,955, 4,869,740, 4,889,545, 5,275,005, 5,555,748, and 5,568,737 describe relevant processes (although the description of the present invention in some cases is based on different processing conditions than those described in the cited U.S. patents).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product.

If the feed gas is not totally condensed (typically it is not), the vapor remaining from the partial condensation can be split into two or more streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained for two main reasons. The first reason is that the conventional demethanizer is operated largely as a stripping column. The methane product of the process, therefore, typically comprises vapors leaving the top fractionation stage of the column, together with vapors not subjected to any rectification step.

Considerable losses of $C_2$ components occur because the top liquid feed contains substantial quantities of $C_2$ components and heavier hydrocarbon components, resulting in corresponding equilibrium quantities of $C_2$ components and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components and heavier hydrocarbon components from the vapors.

The second reason that this ideal situation cannot be obtained is that carbon dioxide contained in the feed gas fractionates in the demethanizer and can build up to concentrations of as much as 5% to 10% or more in the tower even when the feed gas contains less than 1% carbon dioxide. At such high concentrations, formation of solid carbon dioxide can occur depending on temperatures, pressures, and the liquid solubility. It is well known that natural gas streams usually contain carbon dioxide, sometimes in substantial amounts. If the carbon dioxide concentration in the feed gas is high enough, it becomes impossible to process the feed gas as desired due to blockage of the process equipment with solid carbon dioxide (unless carbon dioxide removal equipment is added, which would increase capital cost substantially) The present invention provides a means for generating a liquid reflux stream that will improve the recovery efficiency for the desired products while simultaneously substantially mitigating the problem of carbon dioxide icing.

In accordance with the present invention, it has been found that $C_2$ recoveries in excess of 95 percent can be obtained. Similarly, in those instances where recovery of $C_2$ components is not desired, $C_3$ recoveries in excess of 95% can be maintained. In addition, the present invention makes possible essentially 100 percent separation of methane (or $C_2$ components) and lighter components from the $C_2$ components (or $C_3$ components) and heavier components at reduced energy requirements compared to the prior art while maintaining the same recovery levels and improving the safety factor with respect to the danger of carbon dioxide icing. The present invention, although applicable for leaner gas streams at lower pressures and warmer temperatures, is particularly advantageous when processing richer feed gases at pressures in the range of 600 to 1000 psia or higher under conditions requiring column overhead temperatures of −110° F. or colder.

For a better understanding of the present invention, reference is made to the following examples and drawings. Referring to the drawings:

FIG. 1 is a flow diagram of a cryogenic expansion natural gas processing plant of the prior art according to U.S. Pat. No. 4,278,457;

FIG. 2 is a flow diagram of a cryogenic expansion natural gas processing plant of an alternative prior art system according to U.S. Pat. No. 5,568,737;

In the following explanation of the above figures, tables are provided summarizing flow rates calculated for representative process conditions. In the tables appearing herein, the values for flow rates (in pound moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

DESCRIPTION OF THE PRIOR ART

Figure 1:
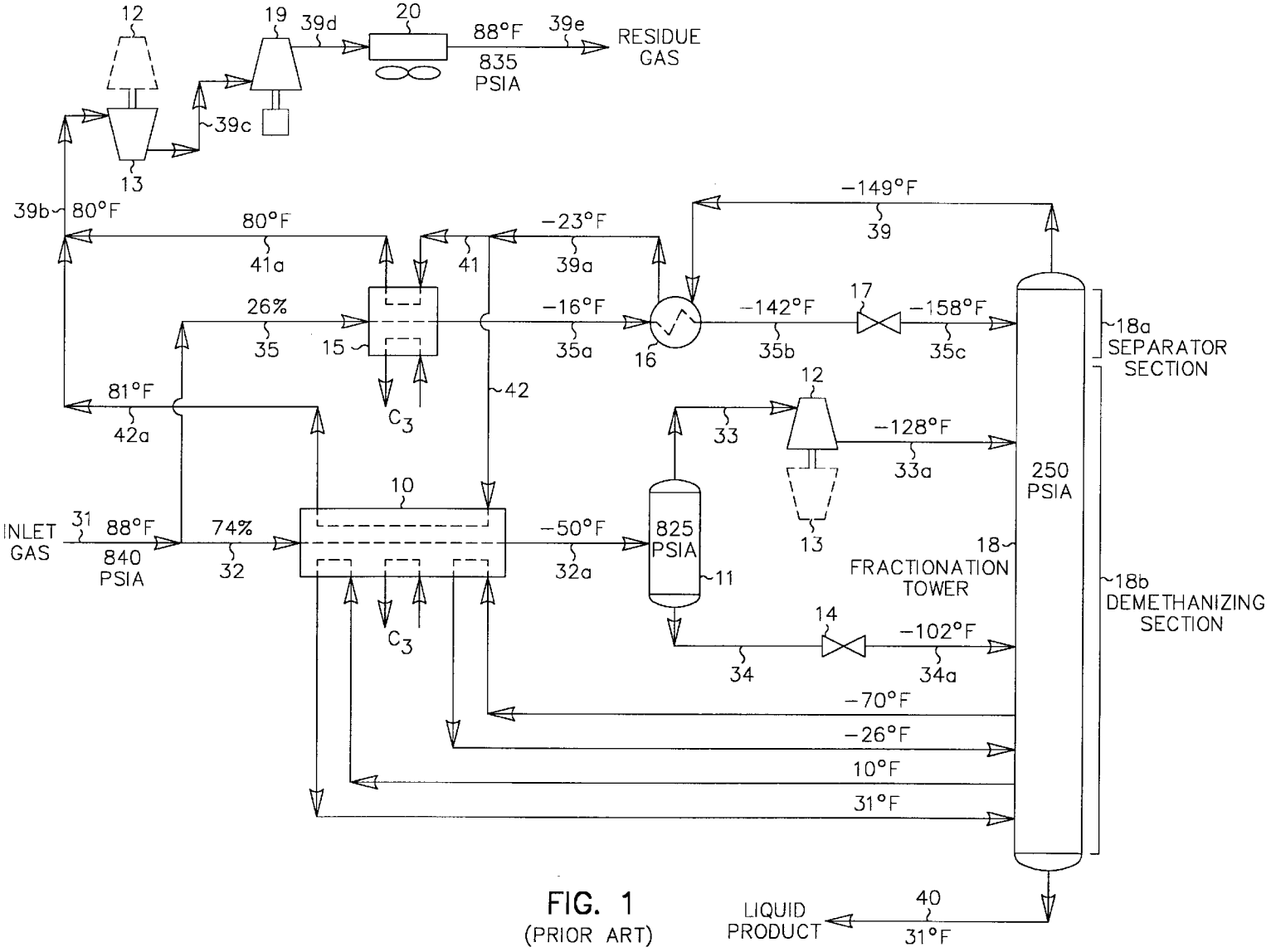
FIG. 1 (PRIOR ART)

Referring now to FIG. 1, in a simulation of the process according to U.S. Pat. No. 4,278,457, feed gas enters the plant at 88° F. and 840 psia as stream 31. If the feed gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is split into two portions, stream 32 and stream 35. Stream 35, containing about 26 percent of the total feed gas, enters heat exchanger 15 and is cooled to −16° F. by heat exchange with a portion of the cool residue gas at −23° F. (stream 41) and with external propane refrigerant. Note that in all cases exchangers 10 and 15 are representative of either a multitude of individual heat exchangers or single multi-pass heat exchangers, or any combination thereof. (The decision as to whether to use more than one heat exchanger for the indicated cooling services will depend on a number of factors including, but not limited to, feed gas flow rate, heat exchanger size, stream temperatures, etc.)

The partially cooled stream 35*a* then enters heat exchanger 16 and is directed in heat exchange relation with the demethanizer overhead vapor stream 39, resulting in further cooling and substantial condensation of the gas stream. The substantially condensed stream 35*b* at −142° F. is then flash expanded through an appropriate expansion device, such as expansion valve 17, to the operating pressure (approximately 250 psia) of the fractionation tower 18. During expansion a portion of the stream is vaporized, resulting in cooling of the total stream. In the process illustrated in FIG. 1, the expanded stream 35*c* leaving expansion valve 17 reaches a temperature of −158° F. and is supplied to separator section 18*a* in the upper region of fractionation tower 18. The liquids separated therein become the top feed to demethanizing section 18*b*.

Returning to the second portion (stream 32) of the feed gas, the remaining 74 percent of the feed gas enters heat exchanger 10 where it is cooled to −50° F. and partially condensed by heat exchange with a portion of the cool residue gas at −23° F. (stream 42), demethanizer reboiler liquids at 10° F., demethanizer side reboiler liquids at −70° F., and external propane refrigerant. The cooled stream 32*a* enters separator 11 at −50° F. and 825 psia where the vapor (stream 33) is separated from the condensed liquid (stream 34).

The vapor from separator 11 (stream 33) enters a work expansion machine 12 in which mechanical energy is extracted from this portion of the high pressure feed. The machine 12 expands the vapor substantially isentropically from a pressure of about 825 psia to a pressure of about 250 psia, with the work expansion cooling the expanded stream 33*a* to a temperature of approximately −128° F. The typical commercially available expanders are capable of recovering on the order of 80–85% of the work theoretically available in an ideal isentropic expansion. The work recovered is often used to drive a centrifugal compressor (such as item 13), that can be used to re-compress the residue gas (stream 39*b*), for example. The expanded and partially condensed stream 33*a* is supplied as feed to distillation column 18 at an intermediate point. The separator liquid (stream 34) is likewise expanded to approximately 250 psia by expansion valve 14, cooling stream 34 to −102° F. (stream 34*a*) before it is supplied to the demethanizer in fractionation tower 18 at a lower mid-column feed point.

The demethanizer in fractionation tower 18 is a conventional distillation column containing a plurality of vertically spaced trays, one or more packed beds, or some combination of trays and packing. As is often the case in natural gas processing plants, the fractionation tower may consist of two sections. The upper section 18*a* is a separator wherein the partially vaporized top feed is divided into its respective vapor and liquid portions, and wherein the vapor rising from the lower distillation or demethanizing section 18*b* is combined with the vapor portion (if any) of the top feed to form the cold residue gas distillation stream 39 which exits the top of the tower. The lower, demethanizing section 18*b* contains the trays and/or packing and provides the necessary contact between the liquids falling downward and the vapors rising upward. The demethanizing section also includes reboilers which heat and vaporize a portion of the liquids flowing down the column to provide the stripping vapors which flow up the column to strip the liquid product, stream 40, of methane. A typical specification for the bottom liquid product is to have a methane to ethane ratio of 0.015:1 on a volume basis. The liquid product stream 40 exits the bottom of the demethanizer at 31° F. and flows to subsequent processing and/or storage.

The cold residue gas stream 39 passes countercurrently to a portion (stream 35*a*) of the feed gas in heat exchanger 16 where it is warmed to −23° F. (stream 39*a*) as it provides further cooling and substantial condensation of stream 35*b*. The cool residue gas stream 39*a* is then divided into two portions, streams 41 and 42. Streams 41 and 42 pass countercurrently to the feed gas in heat exchangers 15 and 10, respectively, and are warmed to 80° F. and 81° F. (streams 41*a* and 42*a*, respectively) as the streams provide cooling and partial condensation of the feed gas. The two warmed streams 41*a* and 42*a* then recombine as residue gas stream 39*b* at a temperature of 80° F. This recombined stream is then re-compressed in two stages. The first stage is compressor 13 driven by expansion machine 12. The second stage is compressor 19 driven by a supplemental power source which compresses the residue gas (stream 39*c*) to sales line pressure. After cooling in discharge cooler 20, the residue gas product (stream 39*e*) flows to the sales gas pipeline at 88° F. and 835 psia.

A summary of stream flow rates and energy consumptions for the process illustrated in FIG. 1 is set forth in the following table:

TABLE I (FIG. 1)
Stream Flow Summary - (Lb. Moles/Hr)

| Stream | Methane | Ethane | Propane | Butanes + | Total |
|---|---|---|---|---|---|
| 31 | 5516 | 1287 | 633 | 371 | 8235 |
| 32 | 4069 | 949 | 467 | 274 | 6075 |
| 35 | 1447 | 338 | 166 | 97 | 2160 |
| 33 | 2235 | 199 | 38 | 8 | 2665 |
| 34 | 1834 | 750 | 429 | 266 | 3410 |
| 39 | 5487 | 64 | 3 | 0 | 5844 |
| 40 | 29 | 1223 | 630 | 371 | 2391 |

TABLE I-continued (FIG. 1)
Stream Flow Summary - (Lb. Moles/Hr)

| Stream | Methane | Ethane | Propane | Butanes + | Total |
|---|---|---|---|---|---|
| | Recoveries* | | | | |
| | Ethane | | | 95.00% | |
| | Propane | | | 99.54% | |
| | Butanes + | | | 99.95% | |
| | Horsepower | | | | |
| | Residue Compression | | | 4,034 | |
| | Refrigeration Compression | | | 1,549 | |
| | Total | | | 5,583 | |

*(Based on un-rounded flow rates)

The prior art illustrated in FIG. 1 is limited to the ethane recovery shown in Table I by the amount of substantially condensed feed gas which can be produced to serve as reflux for the upper rectification section of the demethanizer. The recovery of $C_2$ components and heavier hydrocarbon components can be improved up to a point either by increasing the amount of substantially condensed feed gas supplied as the top feed of the demethanizer, or by lowering the temperature of separator 11 to reduce the temperature of the work expanded feed gas and thereby reduce the temperature and quantity of vapor supplied to the mid-column feed point of the demethanizer that must be rectified. Changes of this type can only be accomplished by removing more energy from the feed gas, either by adding supplemental refrigeration to cool the feed gas further, or by lowering the operating pressure of the demethanizer to increase the energy recovered by work expansion machine 12. In either case, the utility (compression) requirements will increase inordinately while providing only marginal increases in $C_2$+ component recovery levels.

Figure 2:
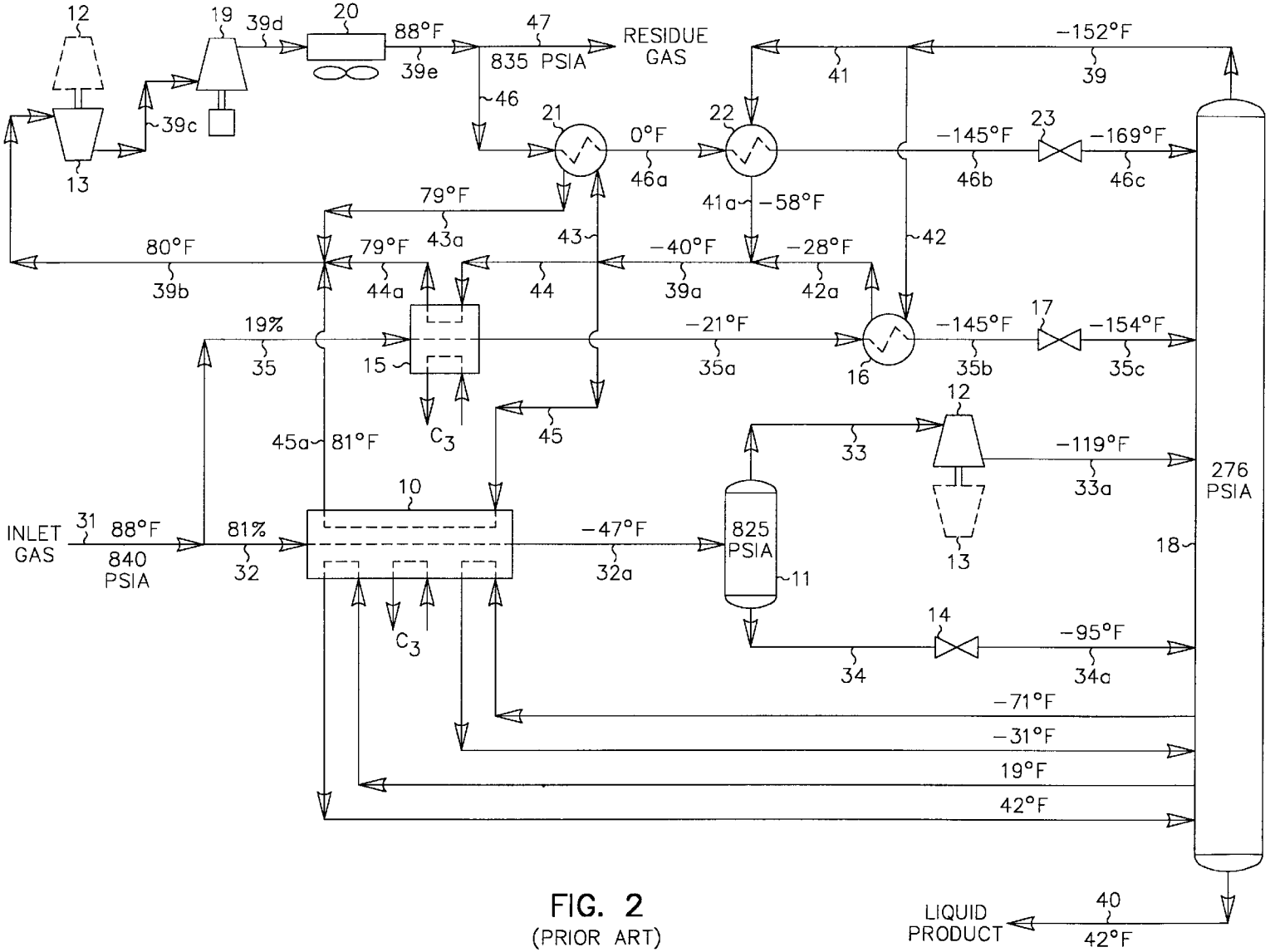
FIG. 2 (PRIOR ART)

One way to achieve more efficient ethane recovery that is often used for rich feed gases such as this (where the recovery is limited by the energy that can be removed from the feed gas) is to substantially condense a portion of the re-compressed residue gas and recycle it to the demethanizer as its top (reflux) feed. In essence, this is an open compression-refrigeration cycle for the demethanizer using a portion of the volatile residue gas as the working fluid. FIG. 2 represents such an alternative prior art process in accordance with U.S. Pat. No. 5,568,737 that recycles a portion of the residue gas product to provide the top feed to the demethanizer. The process of FIG. 2 has been applied to the same feed gas composition and conditions as described above for FIG. 1.

In the simulation of this process, as in the simulation for the process of FIG. 1, operating conditions were selected to minimize energy consumption for a given recovery level. The feed stream 31 is split into two portions, stream 32 and stream 35. Stream 35, containing about 19 percent of the total feed gas, enters heat exchanger 15 and is cooled to −21° F. by heat exchange with a portion of the cool residue gas at −40° F. (stream 44) and with external propane refrigerant. The partially cooled stream 35*a* then enters heat exchanger 16 and is directed in heat exchange relation with a portion of the cold demethanizer overhead vapor at −152° F. (stream 42), resulting in further cooling and substantial condensation of the gas stream. The substantially condensed stream 35*b* at −145° F. is then flash expanded through expansion valve 17 to the operating pressure (approximately 276 psia) of fractionation tower 18. During expansion a portion of the stream vaporizes, cooling the total stream to −154° F. (stream 35*c*). The expanded stream 35*c* then enters the distillation column or demethanizer at a mid-column feed position. The distillation column is in a lower region of fractionation tower 18.

Returning to the second portion (stream 32) of the feed gas, the remaining 81 percent of the feed gas enters heat exchanger 10 where it is cooled to −47° F. and partially condensed by heat exchange with a portion of the cool residue gas at −40° F. (stream 45), demethanizer reboiler liquids at 19° F., demethanizer side reboiler liquids at −71° F., and external propane refrigerant. The cooled stream 32*a* enters separator 11 at −47° F. and 825 psia where the vapor (stream 33) is separated from the condensed liquid (stream 34).

The vapor from separator 11 (stream 33) enters a work expansion machine 12 in which mechanical energy is extracted from this portion of the high pressure feed. The machine 12 expands the vapor substantially isentropically from a pressure of about 825 psia to the pressure of the demethanizer (about 276 psia), with the work expansion cooling the expanded stream to a temperature of approximately −119° F. (stream 33*a*). The separator liquid (stream 34) is likewise expanded to approximately 276 psia by expansion valve 14, cooling stream 34 to −95° F. (stream 34*a*) before it is supplied to the demethanizer in fractionation tower 18 at a lower mid-column feed point.

A portion of the high pressure residue gas (stream 46) is withdrawn from the main residue flow (stream 39*e*) to become the top distillation column feed (reflux). Recycle gas stream 46 passes through heat exchanger 21 in heat exchange relation with a portion of the cool residue gas (stream 43) where it is cooled to 0° F. (stream 46*a*). Cooled recycle stream 46*a* then passes through heat exchanger 22 in heat exchange relation with the other portion of the cold demethanizer overhead distillation vapor, stream 41, resulting in further cooling and substantial condensation of the recycle stream. The substantially condensed stream 46*b* at −145° F. is then expanded through expansion valve 23. As the stream is expanded to the demethanizer operating pressure of 276 psia, a portion of the stream is vaporized, cooling the total stream to a temperature of approximately −169° F. (stream 46*c*). The expanded stream 46*c* is supplied to the tower as the top feed.

The liquid product (stream 40) exits the bottom of tower 18 at 42° F. and flows to subsequent processing and/or storage. The cold distillation stream 39 from the upper section of the demethanizer is divided into two portions, streams 41 and 42. Stream 41 passes countercurrently to recycle stream 46*a* in heat exchanger 22 where it is warmed to −58° F. (stream 41*a*) as it provides cooling and substantial condensation of cooled recycle stream 46*a*. Similarly, stream 42 passes countercurrently to stream 35*a* in heat exchanger 16 where it is warmed to −28° F. (stream 42*a*) as it provides cooling and substantial condensation of stream 35*a*. The two partially warmed streams 41*a* and 42*a* then recombine as stream 39*a* at a temperature of −40° F. This recombined stream is divided into three portions, streams 43, 44, and 45. Stream 43 passes countercurrently to recycle stream 46 in exchanger 21 where it is warmed to 79° F. (stream 43*a*). The second portion, stream 44, flows through heat exchanger 15 where it is heated to 79° F. (stream 44*a*) as it provides cooling to the first portion of the feed gas (stream 35). The third portion, stream 45, flows through heat exchanger 10 where it is heated to 81° F. (stream 45*a*) as it provides cooling to the second portion of the feed gas (stream 32). The three heated streams 43*a*, 44*a*, and 45*a* recombine as warm distillation stream 39*b*. The warm distillation stream at 80° F. is then re-compressed in two stages. The first stage is compressor 13 driven by expansion machine 12. The second stage is compressor 19 driven by a supplemental power source which compresses the residue gas (stream 39*c*) to sales line pressure. After cooling in discharge cooler 20, the cooled stream 39*e* is split into the residue gas product (stream 47) and the recycle stream 46 as described earlier. The residue gas product (stream 47) flows to the sales gas pipeline at 88° F. and 835 psia.

A summary of stream flow rates and energy consumptions for the process illustrated in FIG. 2 is set forth in the following table:

TABLE II (FIG. 2)
Stream Flow Summary - (Lb. Moles/Hr)

| Stream | Methane | Ethane | Propane | Butanes + | Total |
|---|---|---|---|---|---|
| 31 | 5516 | 1287 | 633 | 371 | 8235 |
| 32 | 4478 | 1045 | 514 | 301 | 6685 |
| 35 | 1038 | 242 | 119 | 70 | 1550 |
| 33 | 2607 | 244 | 47 | 10 | 3120 |
| 34 | 1871 | 801 | 467 | 291 | 3565 |
| 39 | 6160 | 72 | 0 | 0 | 6591 |
| 46 | 673 | 8 | 0 | 0 | 720 |
| 47 | 5487 | 64 | 0 | 0 | 5871 |
| 40 | 29 | 1223 | 633 | 371 | 2364 |

| Recoveries* | |
|---|---|
| Ethane | 95.00% |
| Propane | 100.00% |
| Butanes + | 100.00% |
| **Horsepower** | |
| Residue Compression | 4,048 |
| Refrigeration Compression | 1,533 |
| Total | 5,581 |

*(Based on un-rounded flow rates)

Comparison of the recovery levels and utility usages displayed in Tables I and II shows that the refrigeration provided by the addition of recycle stream 46 was not effective for improving the ethane recovery efficiency in this case. Although the substantially condensed and expanded stream 46*c* in the FIG. 2 process is significantly colder and significantly leaner (lower in concentration of $C_2$+ components) than the top feed for the FIG. 1 process (stream 35*c*), the quantity of stream 46*c* is insufficient to absorb the $C_2$+ components in an effective manner from the vapors rising up tower 18. As was the case for the FIG. 1 process, the recovery levels are still set by the amount of energy that can be extracted from the feed gas, meaning that the quantity of top feed (not its composition) is the determining factor that sets the ethane recovery efficiency for this case. The leaner top feed composition that is a feature of the FIG. 2 process could only improve the ethane recovery for this case if the quantity of the top feed was increased, which would increase the horsepower requirements above those listed in Table II.

DESCRIPTION OF THE INVENTION

Example 1

Figure 3:
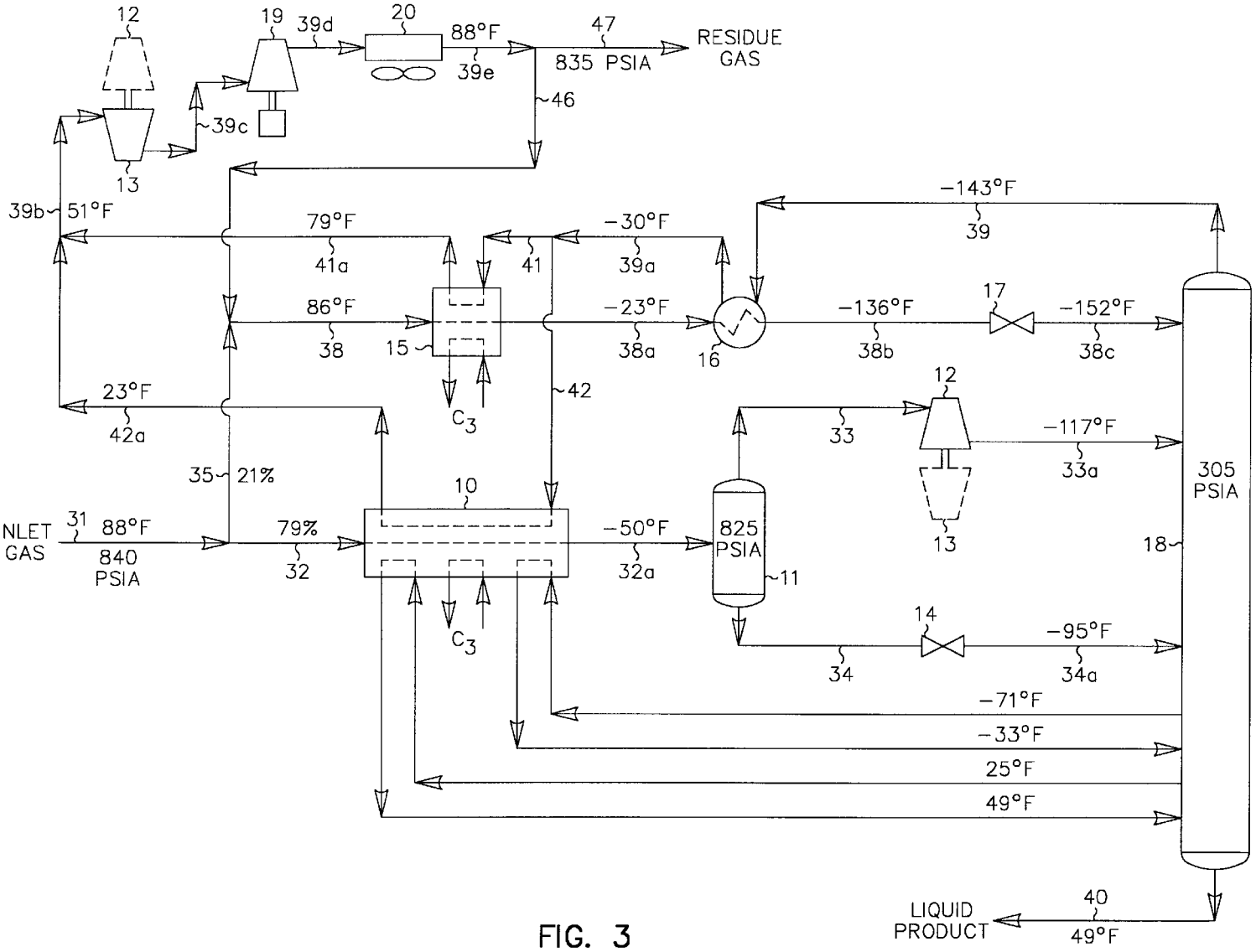
FIG. 3 is a flow diagram of a natural gas processing plant in accordance with the present invention.

FIG. 3 illustrates a flow diagram of a process in accordance with the present invention. The feed gas composition and conditions considered in the process presented in FIG. 3 are the same as those in FIGS. 1 and 2. Accordingly, the FIG. 3 process can be compared with that of the FIG. 1 and FIG. 2 processes to illustrate the advantages of the present invention.

In the simulation of the FIG. 3 process, feed gas enters at 88° F. and 840 psia as stream 31 and is split into two portions, stream 32 and stream 35. Stream 32, containing about 79 percent of the total feed gas, enters heat exchanger 10 and is cooled by heat exchange with a portion of the cool residue gas at −30° F. (stream 42), demethanizer reboiler liquids at 25° F., demethanizer side reboiler liquids at −71° F., and external propane refrigerant. The cooled stream 32*a* enters separator 11 at −50° F. and 825 psia where the vapor (stream 33) is separated from the condensed liquid (stream 34).

The vapor (stream 33) from separator 11 enters a work expansion machine 12 in which mechanical energy is extracted from this portion of the high pressure feed. The machine 12 expands the vapor substantially isentropically from a pressure of about 825 psia to the operating pressure (approximately 305 psia) of fractionation tower 18, with the work expansion cooling the expanded stream 33*a* to a temperature of approximately −117° F. The expanded and partially condensed stream 33*a* is then supplied as feed to distillation column 18 at a mid-column feed point.

The condensed liquid (stream 34) from separator 11 is flash expanded through an appropriate expansion device, such as expansion valve 14, to the operating pressure of fractionation tower 18, cooling stream 34 to a temperature of −95° F. (stream 34*a*). The expanded stream 34*a* leaving expansion valve 14 is then supplied to fractionation tower 18 at a lower mid-column feed point.

Returning to the second portion (stream 35) of the feed gas, the remaining 21 percent of the feed gas is combined with a portion of the high pressure residue gas (stream 46) withdrawn from the main residue flow (stream 39*e*). The combined stream 38 enters heat exchanger 15 and is cooled to −23° F. by heat exchange with the other portion of the cool residue gas at −30° F. (stream 41) and with external propane refrigerant. The partially cooled stream 38*a* then passes through heat exchanger 16 in heat exchange relation with the −143° F. cold distillation stream 39 where it is further cooled to −136° F. (stream 38*b*). The resulting substantially condensed stream 38*b* is then flash expanded through an appropriate expansion device, such as expansion valve 17, to the operating pressure (approximately 305 psia) of fractionation tower 18. During expansion a portion of the stream is vaporized, resulting in cooling of the total stream. In the process illustrated in FIG. 3, the expanded stream 38*c* leaving expansion valve 17 reaches a temperature of −152° F. and is supplied to fractionation tower 18 as the top column feed. The vapor portion (if any) of stream 38*c* combines with the vapors rising from the top fractionation stage of the column to form distillation stream 39, which is withdrawn from an upper region of the tower.

The liquid product (stream 40) exits the bottom of tower 18 at 49° F. and flows to subsequent processing and/or storage. The cold distillation stream 39 at −143° F. from the upper section of the demethanizer passes countercurrently to the partially cooled combined stream 38*a* in heat exchanger 16 where it is warmed to −30° F. (stream 39*a*) as it provides further cooling and substantial condensation of stream 38*b*. The cool residue gas stream 39*a* is then divided into two portions, streams 41 and 42. Stream 41 passes countercurrently to the mixture of feed gas and recycle gas in heat exchanger 15 and is warmed to 79° F. (stream 41*a*) as it provides cooling and partial condensation of the combined stream 38. Stream 42 passes countercurrently to the feed gas in heat exchanger 10 and is warmed to 23° F. (stream 42*a*) as it provides cooling and partial condensation of the feed gas. The two warmed streams 41*a* and 42*a* then recombine as residue gas stream 39*b* at a temperature of 51° F. This recombined stream is then re-compressed in two stages. The first stage is compressor 13 driven by expansion machine 12. The second stage is compressor 19 driven by a supplemental power source which compresses the residue gas (stream 39*c*) to sales line pressure. After cooling in discharge cooler 20, the cooled stream 39*e* is split into the residue gas product (stream 47) and the recycle stream 46 as described earlier. The residue gas product (stream 47) flows to the sales gas pipeline at 88° F. and 835 psia.

A summary of stream flow rates and energy consumptions for the process illustrated in FIG. 3 is set forth in the following table:

TABLE III (FIG. 3)
Stream Flow Summary - (Lb. Moles/Hr)

| Stream | Methane | Ethane | Propane | Butanes + | Total |
|---|---|---|---|---|---|
| 31 | 5516 | 1287 | 633 | 371 | 8235 |
| 32 | 4357 | 1017 | 500 | 293 | 6505 |
| 35 | 1159 | 270 | 133 | 78 | 1730 |
| 33 | 2394 | 213 | 40 | 8 | 2853 |
| 34 | 1963 | 804 | 460 | 285 | 3652 |
| 39 | 6040 | 71 | 3 | 0 | 6444 |
| 46 | 553 | 7 | 0 | 0 | 590 |
| 38 | 1712 | 277 | 133 | 78 | 2320 |
| 47 | 5487 | 64 | 3 | 0 | 5854 |
| 40 | 29 | 1223 | 630 | 371 | 2381 |

| Recoveries* | |
|---|---|
| Ethane | 95.00% |
| Propane | 99.48% |
| Butanes + | 99.93% |
| **Horsepower** | |
| Residue Compression | 3,329 |
| Refrigeration Compression | 1,897 |
| Total | 5,226 |

*(Based on un-rounded flow rates)

Comparison of the recovery levels and utility usages displayed in Tables I and III shows that the present invention maintains essentially the same ethane, propane, and butanes+ recovery as the FIG. 1 process while reducing the horsepower (utility) requirements by about 6 percent. The quantity of the top tower feed for the FIG. 3 process (stream 38*c*) is roughly the same as for the FIG. 1 process (stream 35*c*), but in the present invention a substantial fraction of the top feed is composed of residual methane, resulting in concentrations of $C_2$+ components in the top feed that are significantly lower for the FIG. 3 process. Thus, combining the residual methane in recycle stream 46 with a portion of the feed gas allows the present invention to provide a top reflux stream for demethanizer 18 that is leaner than the feed gas, but which is still of sufficient quantity to be effective in absorbing the $C_2$+ components in the vapors rising up through the tower.

Comparison of the recovery levels and utility usages displayed in Tables II and III shows that the present invention also maintains the same ethane recovery as the FIG. 2 process with a similar reduction of about 6 percent in the horsepower (utility) requirements. Although the FIG. 2 process has slightly better propane recovery (100.00% versus 99.48%) and butanes+ recovery (100.00% versus 99.93%) than the FIG. 3 process, the present invention as depicted in FIG. 3 requires significantly fewer equipment items than the FIG. 2 process, resulting in much lower capital investment. The fractionation tower 18 in the FIG. 3 process also requires fewer contact stages than the corresponding tower in FIG. 2, further reducing capital investment. The reduction in both operating and capital expenses achieved by the present invention is a result of using the mass of a portion of the feed gas to supplement the mass in the residual methane recycle stream, so that there is then sufficient mass in the top reflux feed to the demethanizer to use the refrigeration available in the recycle stream in an effective manner to absorb $C_2$+ components from the vapors rising up through the tower.

Figure 4:
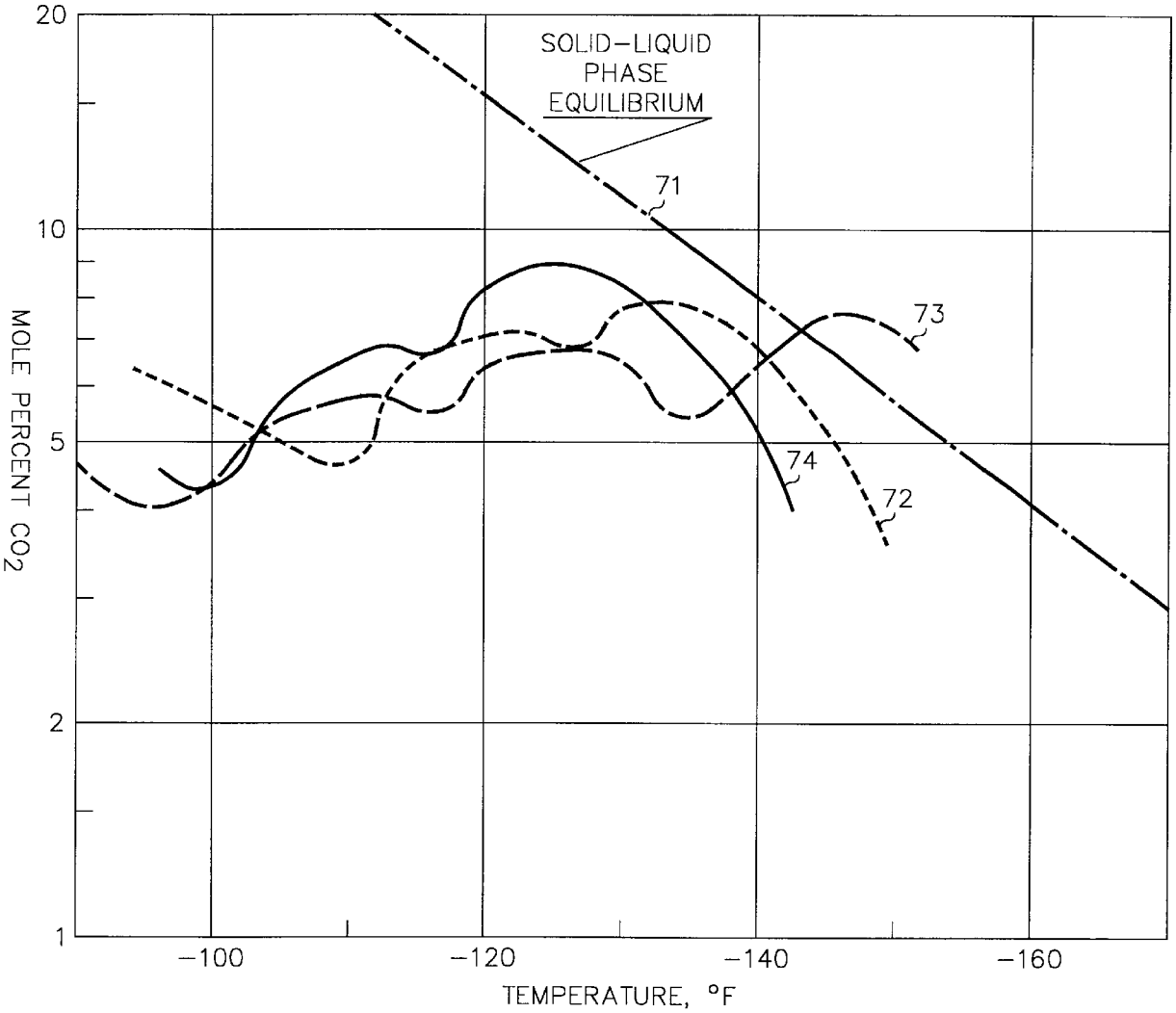
FIG. 4 is a concentration-temperature diagram for carbon dioxide showing the effect of the present invention.

A further advantage of the present invention over the prior art processes is a reduced likelihood of carbon dioxide icing. FIG. 4 is a graph of the relation between carbon dioxide concentration and temperature. Line 71 represents the equilibrium conditions for solid and liquid carbon dioxide in hydrocarbon mixtures like those found on the fractionation stages of demethanizer 18 in FIGS. 1 through 3. (This graph is similar to the one given in the article "Shortcut to $CO_2$ Solubility" by Warren E. White, Karl M. Forency, and Ned P. Baudat, *Hydrocarbon Processing,* V. 52, pp. 107–108, August 1973, but the relationship depicted in FIG. 4 for the liquid-solid equilibrium line has been calculated using an equation of state to properly account for the influence of hydrocarbons heavier than methane.) A liquid temperature on or to the right of line 71, or a carbon dioxide concentration on or above this line, signifies an icing condition. Because of the variations which normally occur in gas processing facilities (e.g., feed gas composition, conditions, and flow rate), it is usually desired to design a demethanizer with a considerable safety factor between the expected operating conditions and the icing conditions. Experience has shown that the conditions of the liquids on the fractionation stages of a demethanizer, rather than the conditions of the vapors, govern the allowable operating conditions in most demethanizers. For this reason, the corresponding vapor-solid equilibrium line is not shown in FIG. 4.

Also plotted in FIG. 4 are lines representing the conditions for the liquids on the fractionation stages of demethanizer 18 in the FIG. 1 and FIG. 2 processes (lines 72 and 73, respectively). For FIG. 1, there is a safety factor of 1.17 between the anticipated operating conditions and the icing conditions. That is, an increase of 17 percent in the carbon dioxide content of the liquid could cause icing. For the FIG. 2 process, however, a portion of the operating line lies to the right of the liquid-solid equilibrium line, indicating that the FIG. 2 process cannot be operated at these conditions without encountering icing problems. As a result, it is not possible to use the FIG. 2 process under these conditions, so its potential for improved efficiency over the FIG. 1 process could not actually be realized in practice without removal of at least some of the carbon dioxide from the feed gas. This would, of course, substantially increase capital cost.

Line 74 in FIG. 4 represents the conditions for the liquids on the fractionation stages of demethanizer 18 in the present invention as depicted in FIG. 3. In contrast to the FIG. 1 and FIG. 2 processes, there is a safety factor of 1.33 between the anticipated operating conditions and the icing conditions for the FIG. 3 process. Thus, the present invention could tolerate nearly double the increase in the concentration of carbon dioxide that the FIG. 1 process could tolerate without risk of icing. Further, whereas the FIG. 2 process cannot be operated to achieve the recovery levels given in Table II because of icing, the present invention could in fact be operated at even higher recovery levels than those given in Table III without risk of icing.

The shift in the operating conditions of the FIG. 3 demethanizer as indicated by line 74 in FIG. 4 can be understood by comparing the distinguishing features of the present invention to the prior art processes of FIGS. 1 and 2. The shape of the operating line for the FIG. 1 process (line 72) is very similar to the shape of the operating line for the present invention. The major difference is that the operating temperatures of the fractionation stages in the demethanizer in the FIG. 3 process are significantly warmer than those of the corresponding fractionation stages in the demethanizer in the FIG. 1 process, effectively shifting the operating line of the FIG. 3 process away from the liquid-solid equilibrium line. The warmer temperatures of the fractionation stages in the FIG. 3 demethanizer are the result of operating the tower at substantially higher pressure than the FIG. 1 process. However, the higher tower pressure does not cause a loss in $C_2$+ component recovery levels because the recycle stream 46 in the FIG. 3 process is in essence an open direct-contact compression-refrigeration cycle for the demethanizer using a portion of the volatile residue gas as the working fluid, supplying needed refrigeration to the process to overcome the loss in recovery that normally accompanies an increase in demethanizer operating pressure.

The prior art FIG. 2 process is similar to the present invention in that it also employs an open compression-refrigeration cycle to supply additional refrigeration to its demethanizer. However, in the present invention, the volatile residue gas working fluid is enriched with heavier hydrocarbons from the feed gas. As a result, the liquids on the fractionation stages in the upper section of the FIG. 3 demethanizer contain higher concentrations of $C_4$+ hydrocarbons than those of the corresponding fractionation stages in the demethanizer in the FIG. 2 process. The effect of these heavier hydrocarbon components (along with the higher operating pressure of the tower) is to raise the bubble point temperatures of the tray liquids. This produces warmer operating temperatures for the fractionation stages in the FIG. 3 demethanizer, once again shifting the operating line of the FIG. 3 process away from the liquid-solid equilibrium line.

Example 2

Figure 5:
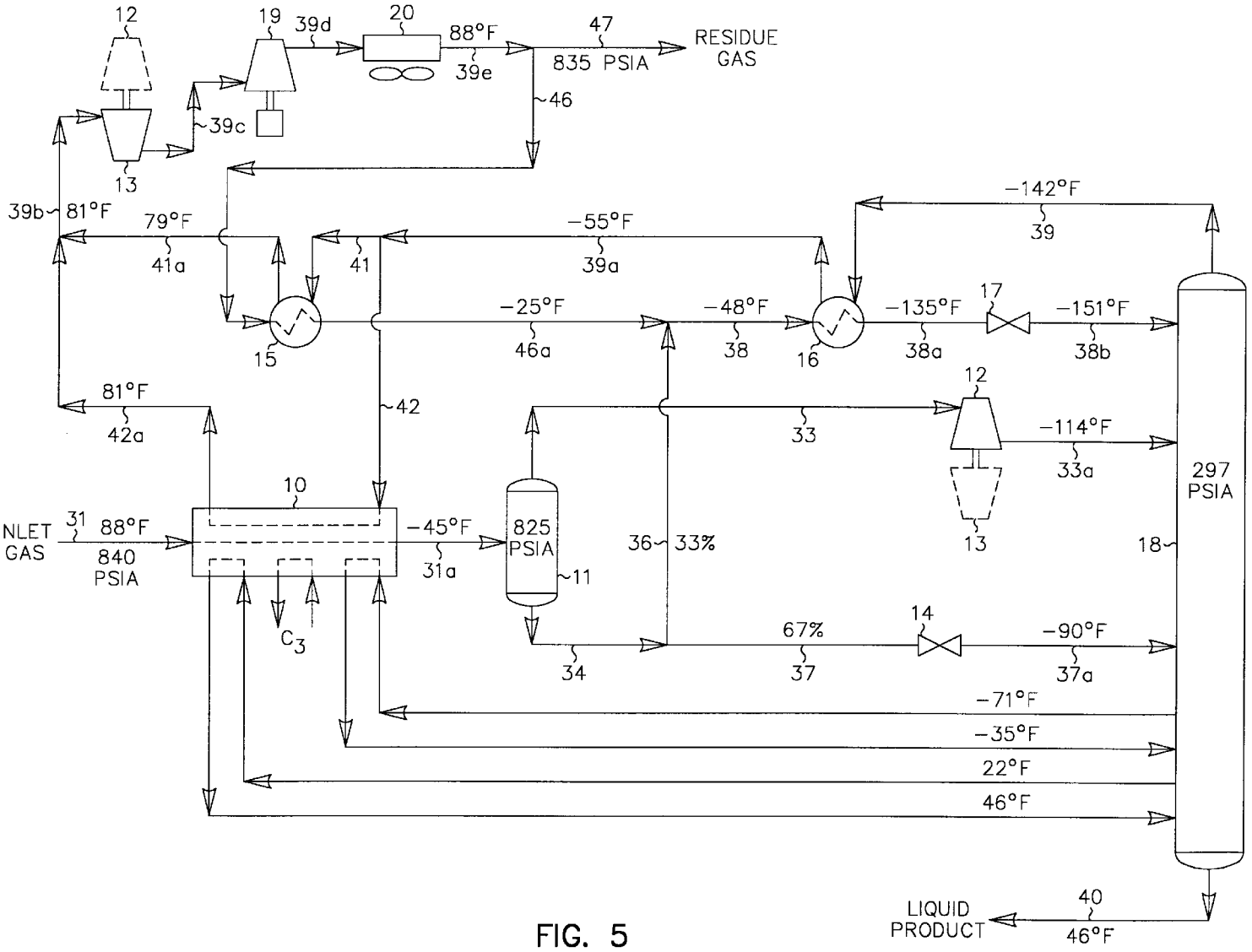
FIG. 5 is a flow diagram illustrating an alternative means of application of the present invention to a natural gas stream.

FIG. 3 represents the preferred embodiment of the present invention for the temperature and pressure conditions shown because it typically requires the least equipment and the lowest capital investment. An alternative method of enriching the recycle stream is shown in another embodiment of the present invention as illustrated in FIG. 5. The feed gas composition and conditions considered in the process presented in FIG. 5 are the same as those in FIGS. 1 through 3. Accordingly, FIG. 5 can be compared with the FIGS. 1 and 2 processes to illustrate the advantages of the present invention, and can likewise be compared to the embodiment displayed in FIG. 3.

In the simulation of the FIG. 5 process, feed gas enters at 88° F. and 840 psia as stream 31 and is cooled in heat exchanger 10 by heat exchange with a portion of the cool residue gas at −55° F. (stream 42), demethanizer reboiler liquids at 22° F., demethanizer side reboiler liquids at −71° F., and external propane refrigerant. The cooled stream 31*a* enters separator 11 at −45° F. and 825 psia where the vapor (stream 33) is separated from the condensed liquid (stream 34).

The vapor (stream 33) from separator 11 enters a work expansion machine 12 in which mechanical energy is extracted from this portion of the high pressure feed. The machine 12 expands the vapor substantially isentropically from a pressure of about 825 psia to the operating pressure (approximately 297 psia) of fractionation tower 18, with the work expansion cooling the expanded stream 33*a* to a temperature of approximately −114° F. The expanded and partially condensed stream 33*a* is then supplied as feed to distillation column 18 at a mid-column feed point.

The condensed liquid (stream 34) from separator 11 is divided into two portions, streams 36 and 37. Stream 37, containing about 67 percent of the total condensed liquid, is flash expanded to the operating pressure (approximately 297 psia) of fractionation tower 18 through an appropriate expansion device, such as expansion valve 14, cooling stream 37 to a temperature of −90° F. (stream 37*a*). The expanded stream 37*a* leaving expansion valve 14 is then supplied to fractionation tower 18 at a lower mid-column feed point.

A portion of the high pressure residue gas (stream 46) is withdrawn from the main residue flow (stream 39*e*) and cooled to −25° F. in heat exchanger 15 by heat exchange with the other portion of the cool residue gas at −55° F. (stream 41). The partially cooled recycle stream 46*a* is then combined with the other portion of the liquid from separator 11, stream 36 containing about 33 percent of the total condensed liquid. The combined stream 38 then passes through heat exchanger 16 in heat exchange relation with the −142° F. cold distillation stream 39 and is cooled to −135° F. (stream 38*a*). The resulting substantially condensed stream 38*a* is then flash expanded through an appropriate expansion device, such as expansion valve 17, to the operating pressure (approximately 297 psia) of fractionation tower 18. During expansion a portion of the stream is vaporized, resulting in cooling of the total stream. In the process illustrated in FIG. 5, the expanded stream 38*b* leaving expansion valve 17 reaches a temperature of −151° F. and is supplied to fractionation tower 18 as the top column feed. The vapor portion (if any) of stream 38*b* combines with the vapors rising from the top fractionation stage of the column to form distillation stream 39, which is withdrawn from an upper region of the tower.

The liquid product (stream 40) exits the bottom of tower 18 at 46° F. and flows to subsequent processing and/or storage. The cold distillation stream 39 at −142° F. from the upper section of the demethanizer passes countercurrently to the combined stream 38 in heat exchanger 16 where it is warmed to −55° F. (stream 39*a*) as it provides cooling and substantial condensation of stream 38*a*. The cool residue gas stream 39*a* is then divided into two portions, streams 41 and 42. Stream 41 passes countercurrently to the recycle gas in heat exchanger 15 and is warmed to 79° F. (stream 41*a*) as it provides cooling of recycle stream 46. Stream 42 passes countercurrently to the feed gas in heat exchanger 10 and is warmed to 81° F. (stream 42*a*) as it provides cooling and partial condensation of the feed gas. The two warmed streams 41*a* and 42*a* then recombine as residue gas stream 39*b* at a temperature of 81° F. This recombined stream is then re-compressed in two stages. The first stage is compressor 13 driven by expansion machine 12. The second stage is compressor 19 driven by a supplemental power source which compresses the residue gas (stream 39*c*) to sales line pressure. After cooling in discharge cooler 20, the cooled stream 39*e* is split into the residue gas product (stream 47) and the recycle stream 46 as described earlier. The residue gas product (stream 47) flows to the sales gas pipeline at 88° F. and 835 psia.

A summary of stream flow rates and energy consumptions for the process illustrated in FIG. 5 is set forth in the following table:

TABLE IV (FIG. 5)
Stream Flow Summary - (Lb. Moles/Hr)

| Stream | Methane | Ethane | Propane | Butanes + | Total |
|---|---|---|---|---|---|
| 31 | 5516 | 1287 | 633 | 371 | 8235 |
| 33 | 3324 | 320 | 63 | 13 | 3989 |
| 34 | 2192 | 967 | 570 | 358 | 4246 |
| 36 | 723 | 319 | 188 | 118 | 1400 |
| 37 | 1469 | 648 | 382 | 240 | 2846 |
| 39 | 6706 | 78 | 5 | 0 | 7151 |
| 46 | 1219 | 14 | 1 | 0 | 1300 |
| 38 | 1942 | 333 | 189 | 118 | 2700 |
| 47 | 5487 | 64 | 4 | 0 | 5851 |
| 40 | 29 | 1223 | 629 | 371 | 2384 |

| Recoveries* | |
|---|---|
| Ethane | 95.00% |
| Propane | 99.40% |
| Butanes + | 99.92% |
| **Horsepower** | |
| Residue Compression | 3,960 |
| Refrigeration Compression | 1,515 |
| Total | 5,475 |

*(Based on un-rounded flow rates)

Figure 6:
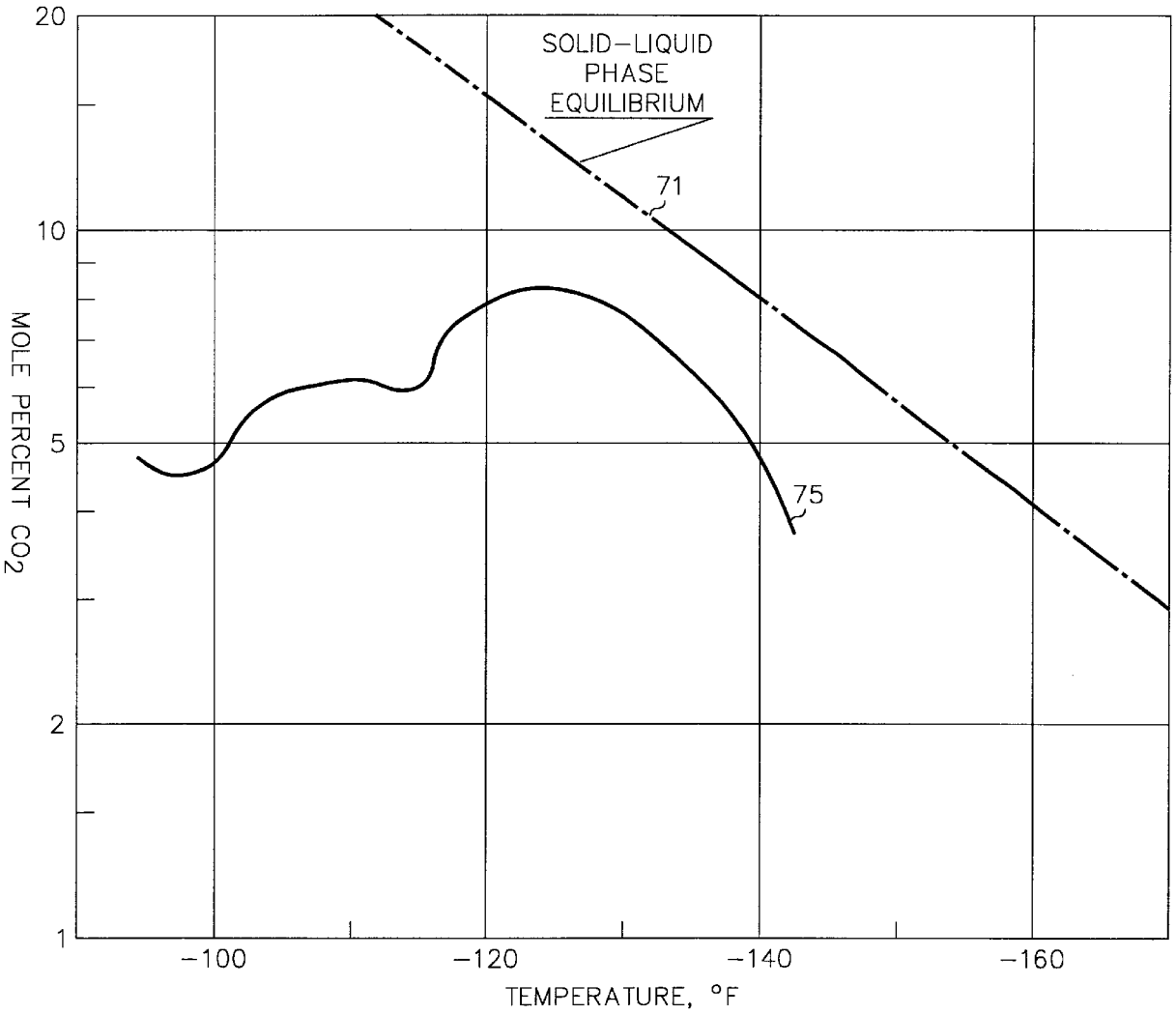
FIG. 6 is a concentration-temperature diagram for carbon dioxide showing the effect of the present invention with respect to the process of FIG. 5.

A comparison of Tables III and IV shows that this embodiment of the present invention (FIG. 5) is capable of achieving essentially the same product recoveries as the previously shown embodiment of FIG. 3, although requiring higher horsepower (utility) requirements. When the present invention is employed as in Example 2 using a portion of the condensed liquid to enrich the recycle stream, however, the advantage with regard to avoiding carbon dioxide icing conditions is further enhanced compared to the FIG. 3 embodiment. FIG. 6 is another graph of the relation between carbon dioxide concentration and temperature, with line 71 as before representing the equilibrium conditions for solid and liquid carbon dioxide in hydrocarbon mixtures like those found on the fractionation stages of demethanizer 18 in FIGS. 1, 2, 3, and 5. Line 75 in FIG. 6 represents the conditions for the liquids on the fractionation stages of demethanizer 18 in the present invention as depicted in FIG. 5, and shows a safety factor of 1.45 between the anticipated operating conditions and the icing conditions for the FIG. 5 process. Thus, this embodiment of the present invention could tolerate an increase of 45 percent in the concentration of carbon dioxide without risk of icing. In practice, this improvement in the icing safety factor could be used to advantage by operating the demethanizer at lower pressure (i.e., with colder temperatures on the fractionation stages) to raise the $C_2$+ component recovery levels without encountering icing problems. The shape of line 75 in FIG. 6 is very similar to that of line 74 in FIG. 4. The primary difference is the somewhat warmer operating temperatures of the fractionation stages in the FIG. 5 demethanizer due to the effect on the liquid bubble point temperatures from higher concentrations of heavier hydrocarbons in this embodiment when the condensed liquid is used to enrich the recycle stream.

Example 3

Figure 7:
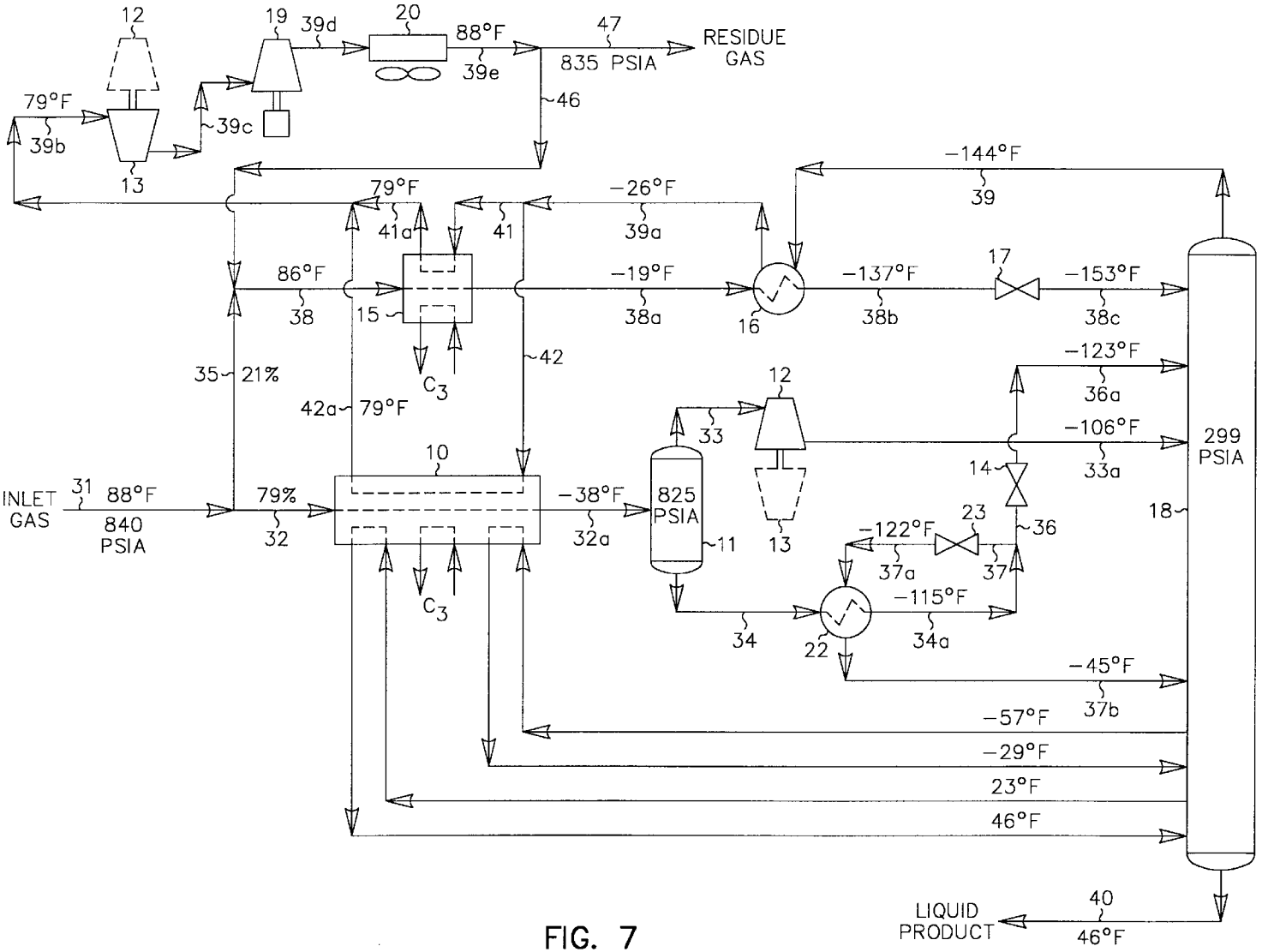
FIG. 7 is a flow diagram illustrating another alternative means of application of the present invention to a natural gas stream.

A third embodiment of the present invention is shown in FIG. 7, wherein additional equipment is used to further improve the recovery efficiency of the present invention. The feed gas composition and conditions considered in the process illustrated in FIG. 7 are the same as those in FIGS. 1, 2, 3, and 5.

In the simulation of the FIG. 7 process, the feed gas splitting, cooling, and separation scheme and the recycle enrichment scheme are essentially the same as those used in FIG. 3. The difference lies in the disposition of the condensed liquids leaving separator 11 (stream 34). Rather than flash expanding the liquid stream and feeding it directly to the fractionation tower at a lower mid-column feed point, the so-called auto-refrigeration process can be employed to cool a portion of the liquids so that they can become an effective upper mid-column feed stream.

The feed gas enters at 88° F. and 840 psia as stream 31 and is split into two portions, stream 32 and stream 35. Stream 32, containing about 79 percent of the total feed gas, enters heat exchanger 10 and is cooled by heat exchange with a portion of the cool residue gas at −26° F. (stream 42), demethanizer reboiler liquids at 23° F., demethanizer side reboiler liquids at −57° F., and external propane refrigerant. The cooled stream 32*a* enters separator 11 at −38° F. and 825 psia where the vapor (stream 33) is separated from the condensed liquid (stream 34).

The vapor (stream 33) from separator 11 enters a work expansion machine 12 in which mechanical energy is extracted from this portion of the high pressure feed. The machine 12 expands the vapor substantially isentropically from a pressure of about 825 psia to the operating pressure (approximately 299 psia) of fractionation tower 18, with the work expansion cooling the expanded stream 33*a* to a temperature of approximately −106° F. The expanded and partially condensed stream 33*a* is then supplied as feed to distillation column 18 at a mid-column feed point.

The condensed liquid (stream 34) from separator 11 is directed to heat exchanger 22 where it is cooled to −115° F. (stream 34*a*). The subcooled stream 34*a* is then divided into two portions, streams 36 and 37. Stream 37 is flash expanded through an appropriate expansion device, such as expansion valve 23, to slightly above the operating pressure of fractionation tower 18. During expansion a portion of the liquid vaporizes, cooling the total stream to a temperature of −122° F. (stream 37*a*). The flash expanded stream 37*a* is then routed to heat exchanger 22 to supply the cooling of stream 34 as described earlier. The resulting warmed stream 37*b*, at a temperature of −45° F., is thereafter supplied to fractionation tower 18 at a lower mid-column feed point. The other portion of subcooled liquid (stream 36) is also flash expanded through an appropriate expansion device, such as expansion valve 14. During the flash expansion to the operating pressure of the demethanizer (approximately 299 psia), a portion of the liquid vaporizes, cooling the total stream to a temperature of −123° F. (stream 36*a*). The flash expanded stream 36*a* is then supplied to fractionation tower 18 at an upper mid-column feed point, above the feed point of work expanded stream 33*a*.

Returning to the second portion (stream 35) of the feed gas, the remaining 21 percent of the feed gas is combined with a portion of the high pressure residue gas (stream 46) withdrawn from the main residue flow (stream 39*e*). The combined stream 38 enters heat exchanger 15 and is cooled to −19° F. by heat exchange with the other portion of the cool residue gas at −26° F. (stream 41) and with external propane refrigerant. The partially cooled stream 38*a* then passes through heat exchanger 16 in heat exchange relation with the −144° F. cold distillation stream 39 where it is further cooled to −137° F. (stream 38*b*). The resulting substantially condensed stream 38*b* is then flash expanded through an appropriate expansion device, such as expansion valve 17, to the operating pressure (approximately 299 psia) of fractionation tower 18. During expansion a portion of the stream is vaporized, resulting in cooling of the total stream. In the process illustrated in FIG. 7, the expanded stream 38*c* leaving expansion valve 17 reaches a temperature of −153° F. and is supplied to fractionation tower 18 as the top column feed. The vapor portion (if any) of stream 38*c* combines with the vapors rising from the top fractionation stage of the column to form distillation stream 39, which is withdrawn from an upper region of the tower.

The liquid product (stream 40) exits the bottom of tower 18 at 46° F. and flows to subsequent processing and/or storage. The cold distillation stream 39 at −144° F. from the upper section of the demethanizer passes countercurrently to the partially cooled combined stream 38*a* in heat exchanger 16 where it is warmed to −26° F. (stream 39*a*) as it provides further cooling and substantial condensation of stream 38*b*. The cool residue gas stream 39*a* is then divided into two portions, streams 41 and 42. Stream 41 passes countercurrently to the mixture of feed gas and recycle gas in heat exchanger 15 and is warmed to 79° F. (stream 41*a*) as it provides cooling and partial condensation of the combined stream 38. Stream 42 passes countercurrently to the feed gas in heat exchanger 10 and is warmed to 79° F. (stream 42*a*) as it provide cooling and partial condensation of the feed gas. The two warmed streams 41*a* and 42*a* then recombine as residue gas stream 39*b* at a temperature of 79° F. This recombined stream is then re-compressed in two stages. The first stage is compressor 13 driven by expansion machine 12. The second stage is compressor 19 driven by a supplemental power source which compresses the residue gas (stream 39*c*) to sales line pressure. After cooling in discharge cooler 20, the cooled stream 39*e* is split into the residue gas product (stream 47) and the recycle stream 46 as described earlier. The residue gas product (stream 47) flows to the sales gas pipeline at 88° F. and 835 psia.

A summary of stream flow rates and energy consumptions for the process illustrated in FIG. 7 is set forth in the following table:

TABLE V (FIG. 7)
Stream Flow Summary - (Lb. Moles/Hr)

| Stream | Methane | Ethane | Propane | Butanes + | Total |
|---|---|---|---|---|---|
| 31 | 5516 | 1287 | 633 | 371 | 8235 |
| 32 | 4357 | 1017 | 500 | 293 | 6505 |
| 35 | 1159 | 270 | 133 | 78 | 1730 |
| 33 | 2898 | 309 | 64 | 14 | 3515 |
| 34 | 1459 | 708 | 436 | 279 | 2990 |
| 36 | 622 | 302 | 186 | 119 | 1275 |
| 37 | 837 | 406 | 250 | 160 | 1715 |
| 39 | 6041 | 71 | 3 | 0 | 6435 |
| 46 | 554 | 7 | 0 | 0 | 590 |
| 38 | 1713 | 277 | 133 | 78 | 2320 |
| 47 | 5487 | 64 | 3 | 0 | 5845 |
| 40 | 29 | 1223 | 630 | 371 | 2390 |

| Recoveries* | |
|---|---|
| Ethane | 95.00% |
| Propane | 99.50% |
| Butanes + | 99.93% |
| **Horsepower** | |
| Residue Compression | 3,516 |
| Refrigeration Compression | 1,483 |
| Total | 4,999 |

*(Based on un-rounded flow rates)

Figure 8:
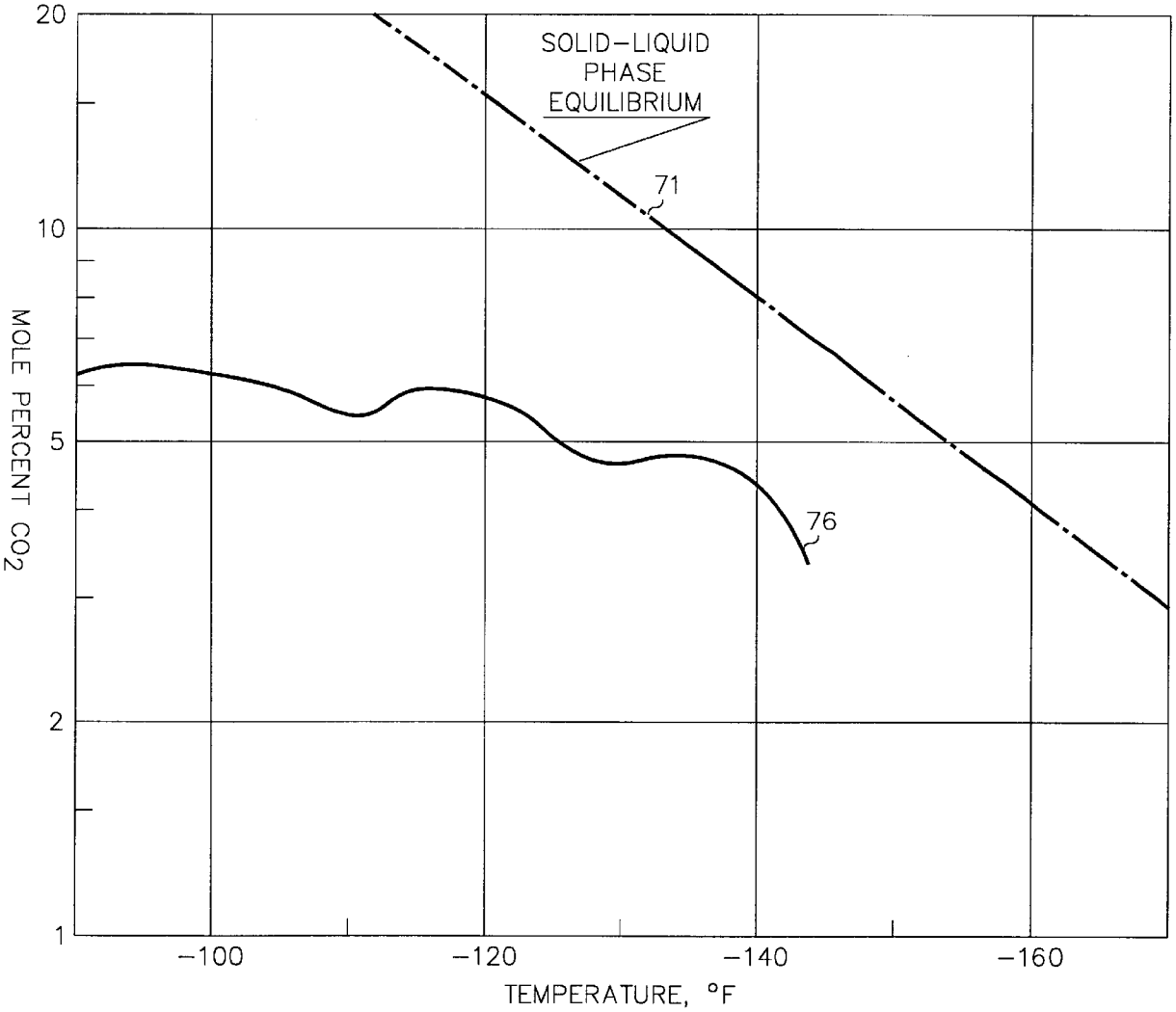
FIG. 8 is a concentration-temperature diagram for carbon dioxide showing the effect of the present invention with respect to the process of FIG. 7.

A comparison of Tables III and V shows that this embodiment of the present invention (FIG. 7) is capable of achieving essentially the same product recoveries as the previously shown embodiment of FIG. 3, while requiring even lower horsepower (utility) requirements (i.e., about 10 percent lower than the prior art processes depicted in FIGS. 1 and 2). In addition, the advantage with regard to avoiding carbon dioxide icing conditions is further enhanced compared to the FIG. 3 and FIG. 5 embodiments. FIG. 8 is another graph of the relation between carbon dioxide concentration and temperature, with line 71 as before representing the equilibrium conditions for solid and liquid carbon dioxide in hydrocarbon mixtures like those found on the fractionation stages of demethanizer 18 in FIGS. 1, 2, 3, 5, and 7. Line 76 in FIG. 8 represents the conditions for the liquids on the fractionation stages of demethanizer 18 in the present invention as depicted in FIG. 7, and shows a safety factor of 1.84 between the anticipated operating conditions and the icing conditions for the FIG. 7 process. Thus, this embodiment of the present invention could tolerate an increase of 84 percent in the concentration of carbon dioxide without risk of icing. In practice, this improvement in the icing safety factor could be used to advantage by operating the demethanizer at lower pressure (i.e., with colder temperatures on the fractionation stages) to raise the $C_2$+ component recovery levels without encountering icing problems. The carbon dioxide concentrations for line 76 in FIG. 8 are significantly lower than those of line 74 in FIG. 4. This is due to the absorption of carbon dioxide by the heavy hydrocarbon components in the upper mid-column feed, stream 36*a*, preventing the carbon dioxide from concentrating as much in the upper section of the demethanizer in the FIG. 7 process as it does in the previous embodiments.

Other Embodiments

Figure 9:
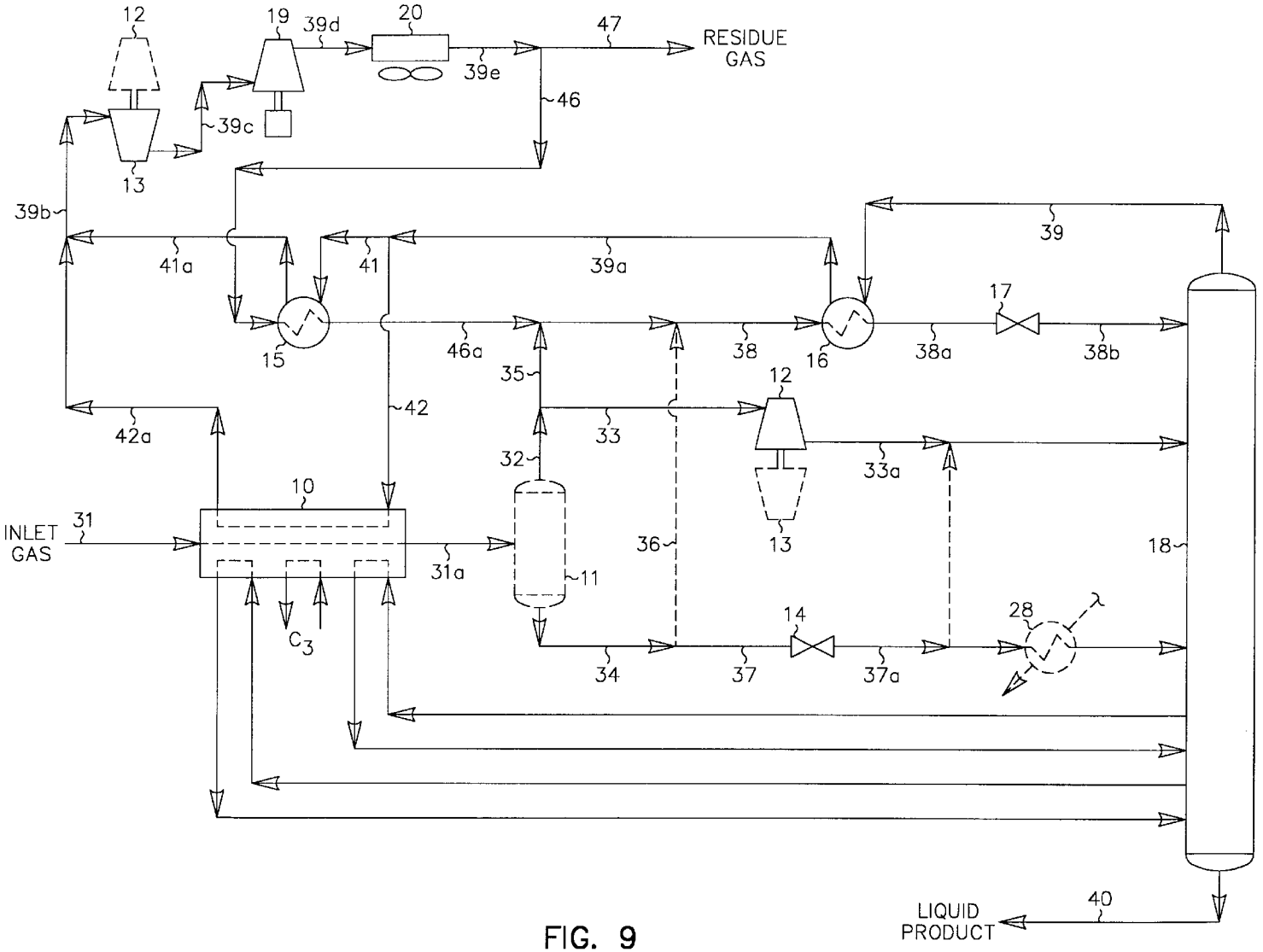
FIGS. 9 through 17 are flow diagrams illustrating alternative embodiments of the present invention.

In accordance with this invention, the enriching of the recycle stream with heavier hydrocarbons can be accomplished in a number of ways. In the embodiments of FIGS. 3 and 7, this enrichment is accomplished by blending a portion of the feed gas with the recycle gas prior to any cooling of the feed gas. In the embodiment of FIG. 5, the enrichment is accomplished by blending the recycle gas with a portion of the condensed liquid that results after cooling the feed gas. As illustrated in FIG. 9, the enrichment could instead be accomplished by blending the recycle gas with a portion (stream 35) of the vapor remaining after cooling and partial condensation of the feed gas. In addition, the enrichment shown in FIG. 9 could be enhanced by also blending all or a portion of the condensed liquid (stream 36) that results after cooling of the feed gas. The remaining portion, if any, of the condensed liquid (stream 37) may be used for feed gas cooling or other heat exchange service before or after the expansion step prior to flowing to the demethanizer. In some embodiments, vapor splitting may be effected in a separator. Alternatively, the separator 11 in the processes shown in FIG. 9 may be unnecessary if the feed gas is relatively lean.

Figure 10:
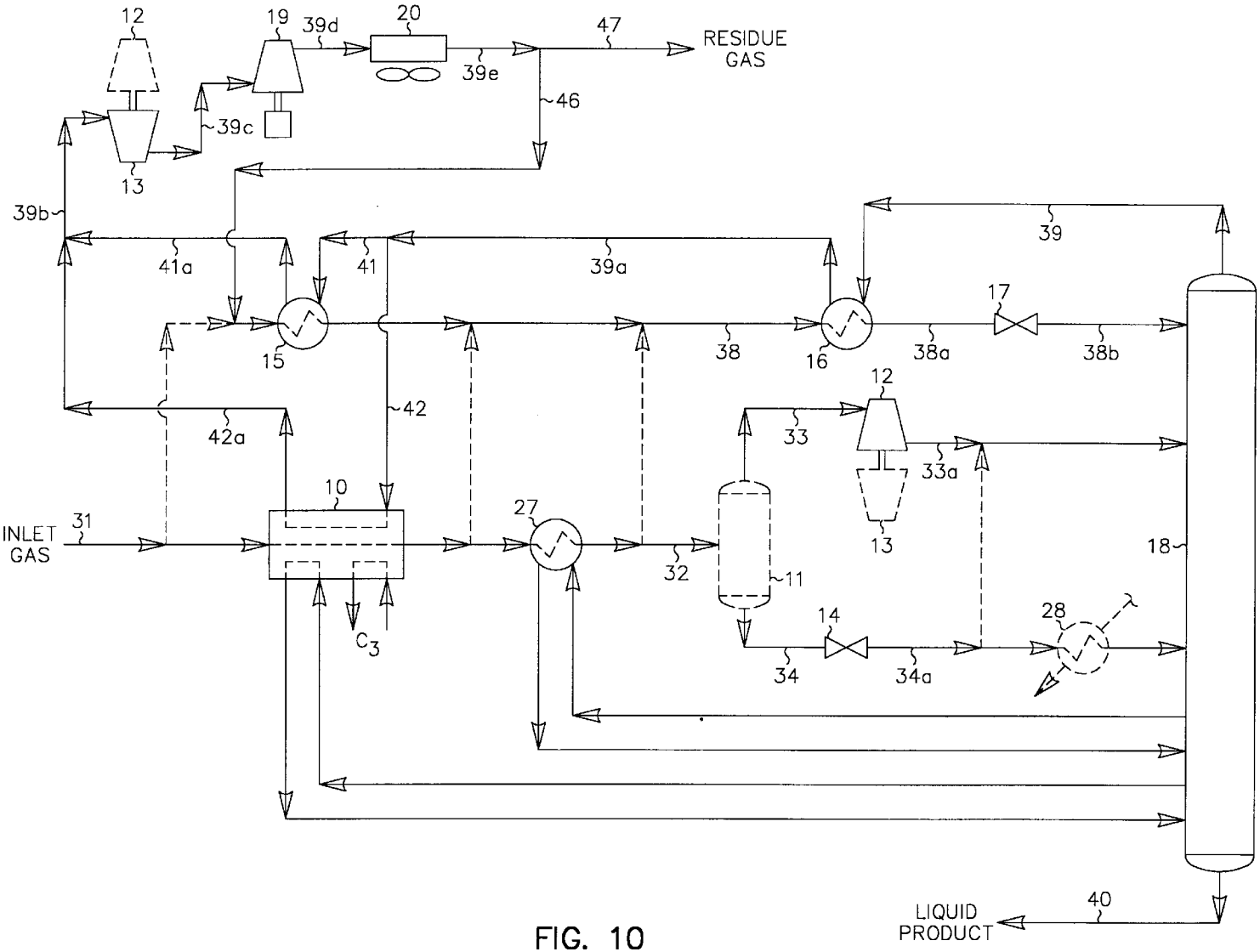

As depicted in FIG. 10, the enrichment can also be accomplished by blending the recycle gas with a portion of the feed gas before cooling, or after cooling but prior to any separation of liquids that may be condensed from the feed gas. Any liquid that is condensed (stream 34) from the feed gas may be expanded and fed to the demethanizer, or may be used for feed gas cooling or other heat exchange service before or after the expansion step prior to flowing to the demethanizer. The separator 11 in the processes shown in FIG. 10 may be unnecessary if the feed gas is relatively lean.

Figure 11:
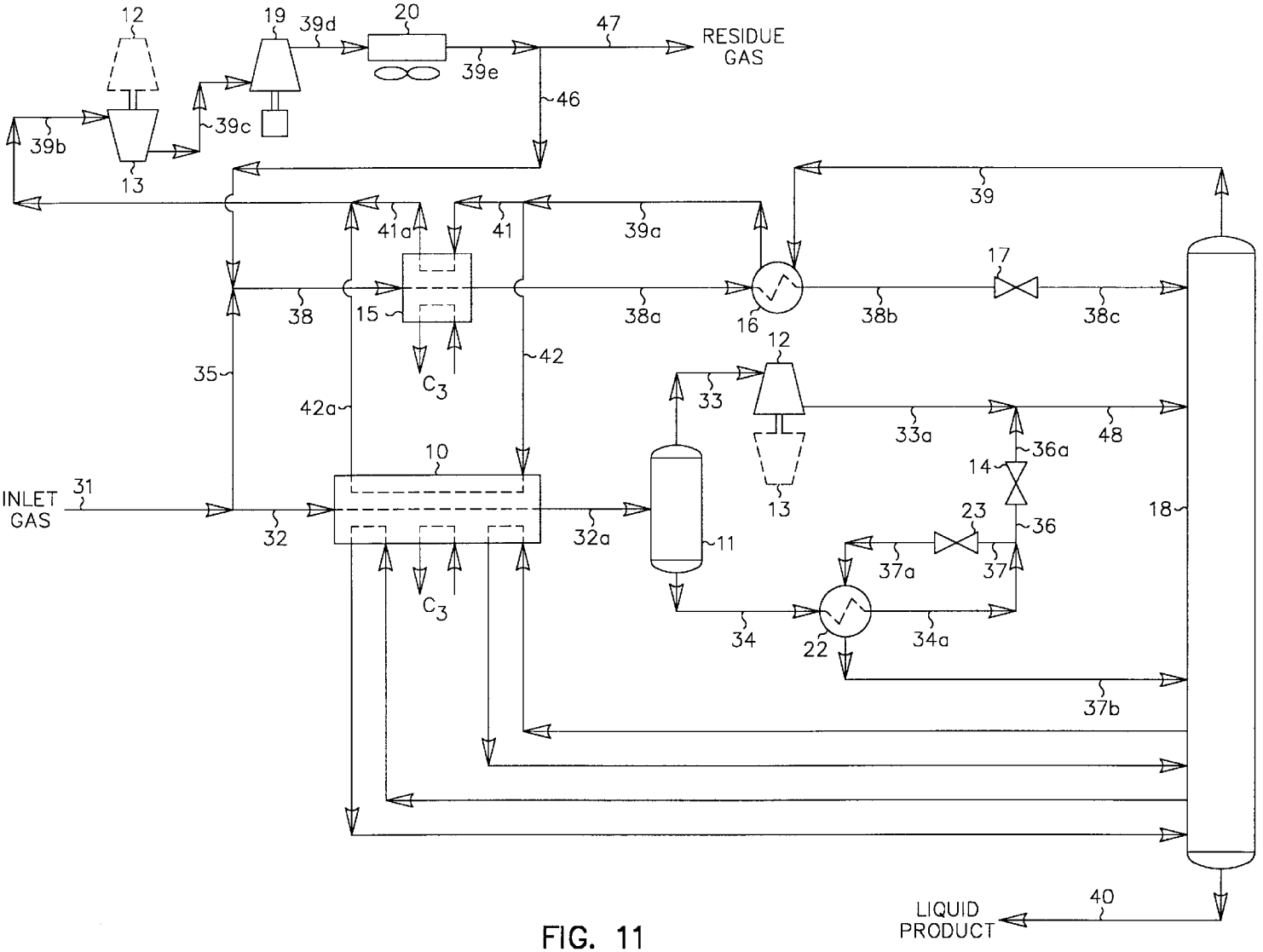

Depending on the relative temperatures and quantities of individual streams, two or more of the feed streams, or portions thereof, may be combined and the combined stream then fed to a mid-column feed position. For example, as depicted in FIG. 9, the remaining portion of the condensed liquid (stream 37) can be flash expanded by expansion valve 14, and then all or a portion of the flash expanded stream 37*a* combined with at least a portion of the work expanded stream 33*a* to form a combined stream that is then supplied to column 18 at a mid-column feed position. Similarly, as depicted in FIGS. 10 and 11, all or a portion of the flash expanded stream (stream 34*a* in FIG. 10, stream 36*a* in FIG. 11) can be combined with at least a portion of the work expanded stream 33*a* to form a combined stream that is then supplied to column 18 at a mid-column feed position.

Figure 12:
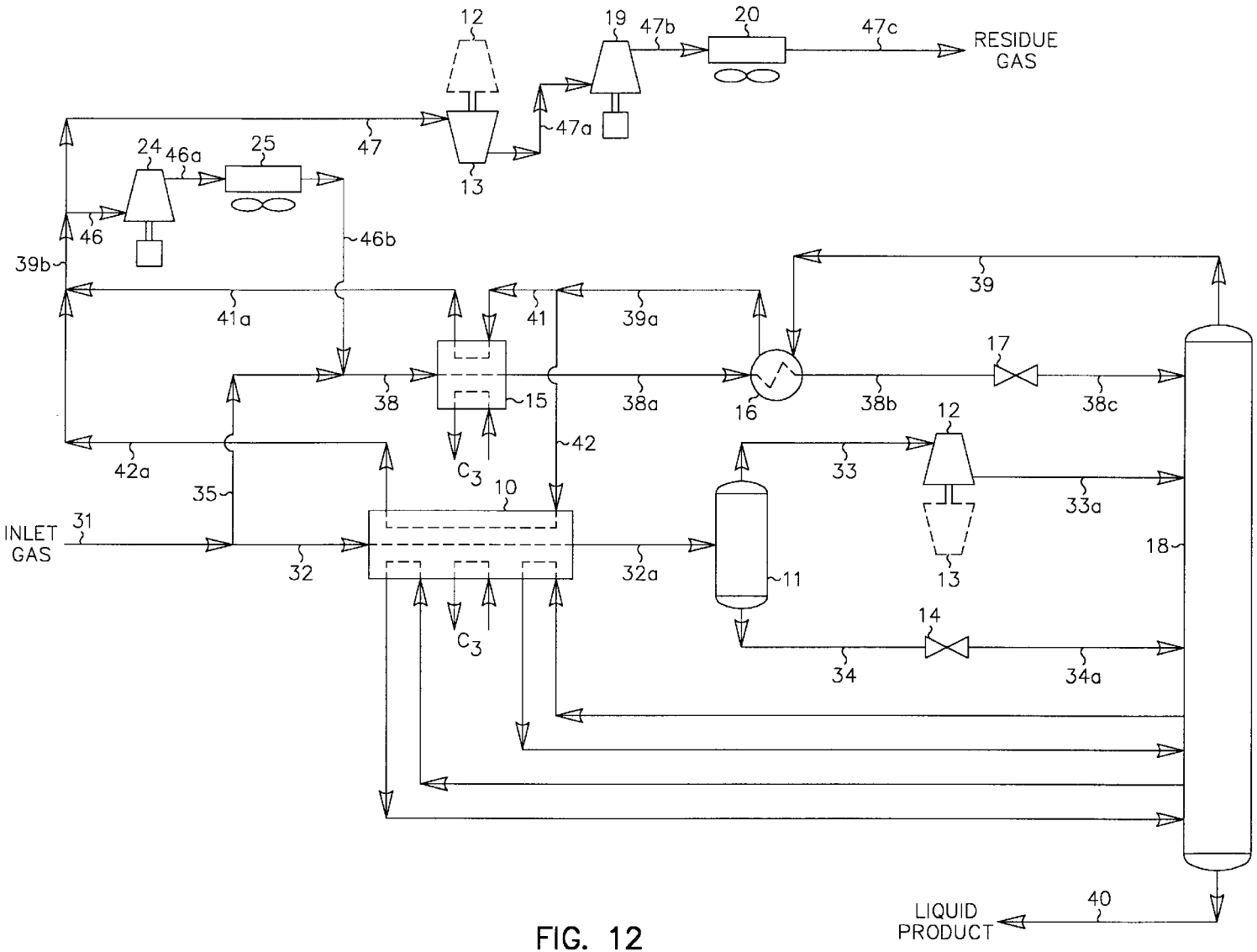
Figure 13:
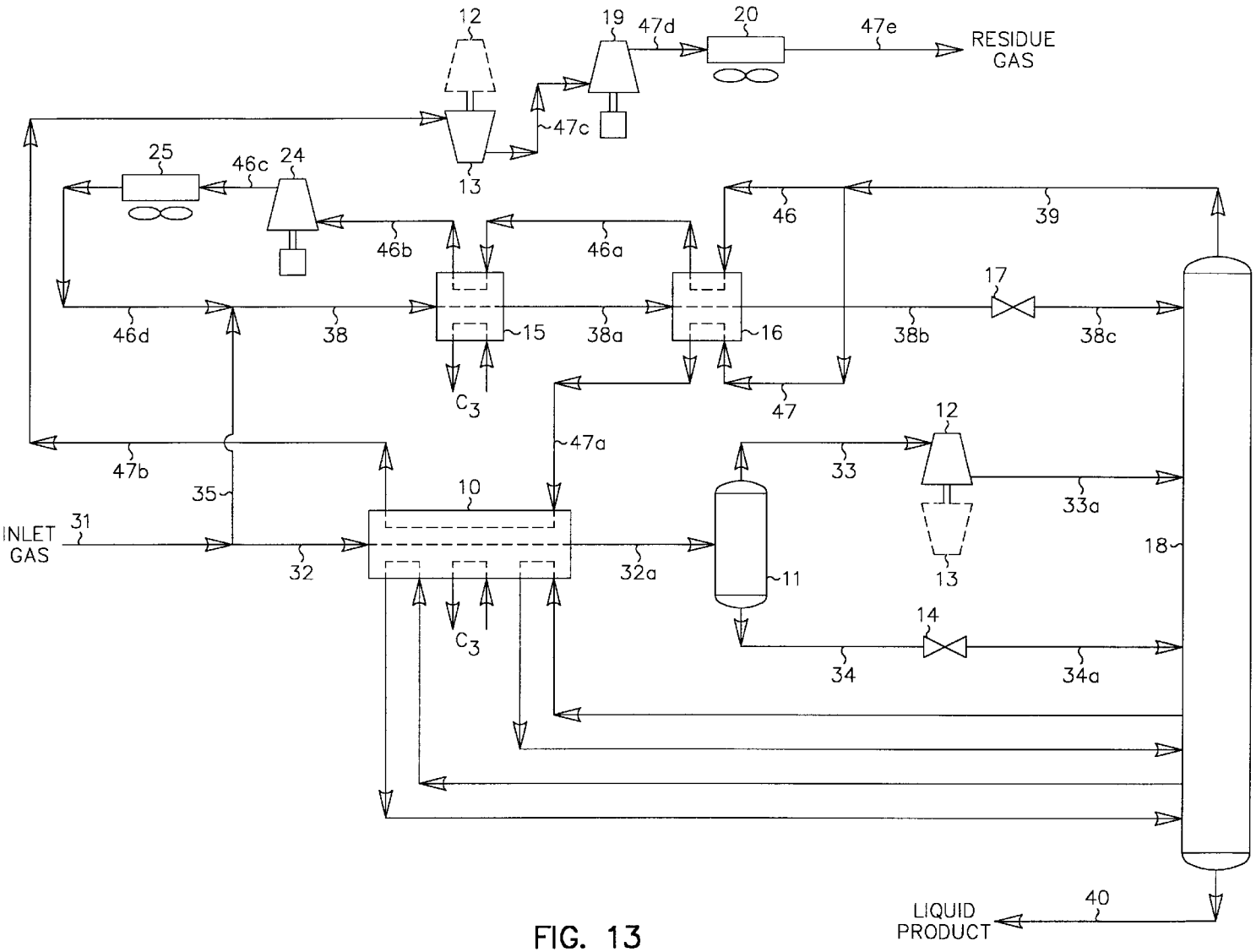

The examples of the present invention depicted in FIGS. 3, 5, 7, 9, 10, and 11 illustrate withdrawal of recycle stream 46 after distillation stream 39 has been heated by heat exchange with the feed streams and has been compressed to pipeline pressure. Depending on plant size, equipment cost and availability, etc., it may be advantageous to withdraw recycle stream 46 after heating but prior to compression, as depicted in FIG. 12. In such an embodiment, a separate compressor 24 and discharge cooler 25 can be used to raise the pressure of recycle stream 46*b* so that it can then combine with a portion (stream 35) of the feed gas. Alternatively, as depicted in FIG. 13, recycle stream 46 may be withdrawn from distillation stream 39 prior to either heating or compression. Recycle stream 46 can be used to supply a portion of the feed gas cooling, then flow to a separate compressor 24 and discharge cooler 25 to raise the pressure of recycle stream 46*d* so that it can combine with a portion (stream 35) of the feed gas.

Figure 14:
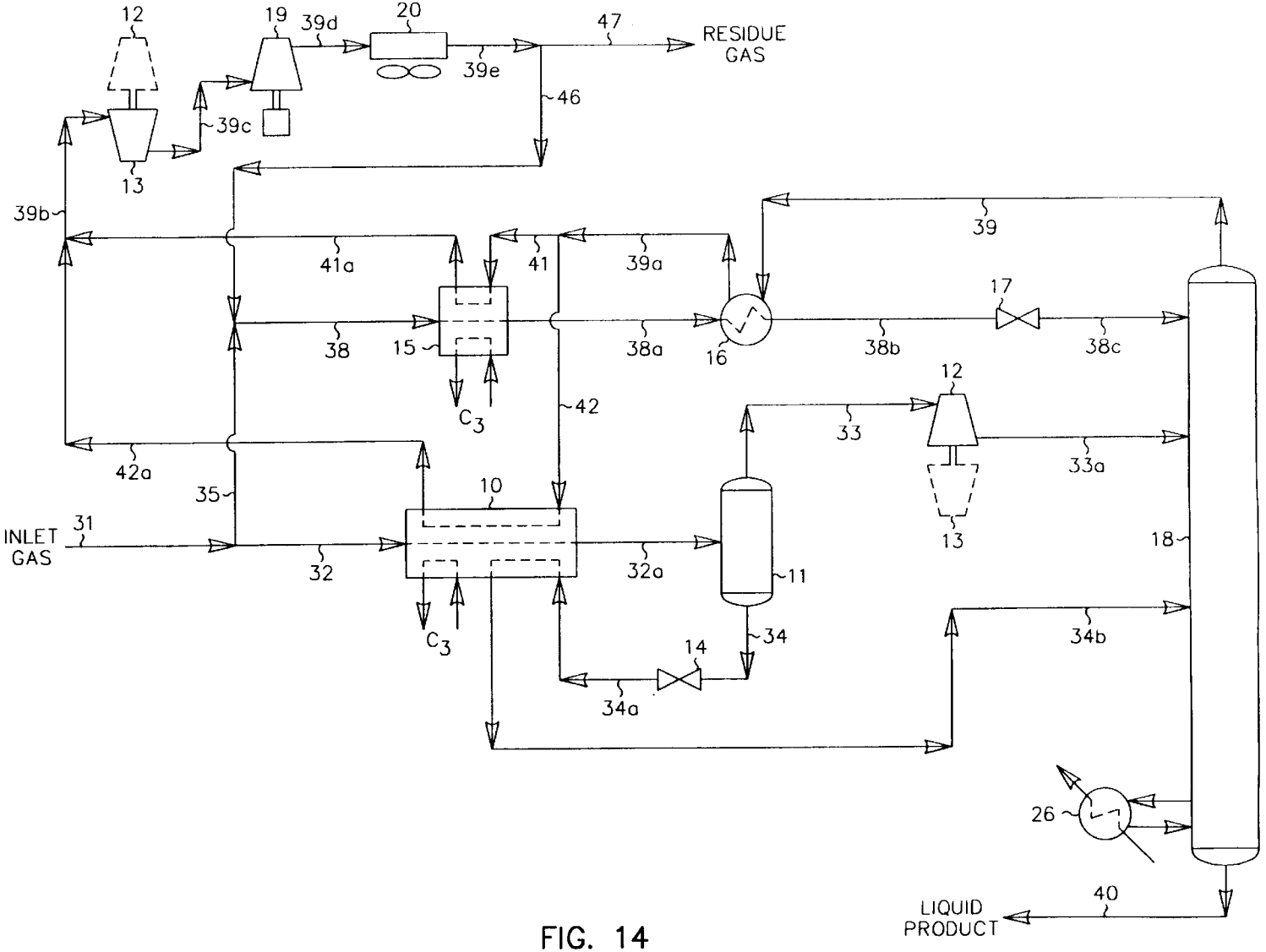
Figure 15:
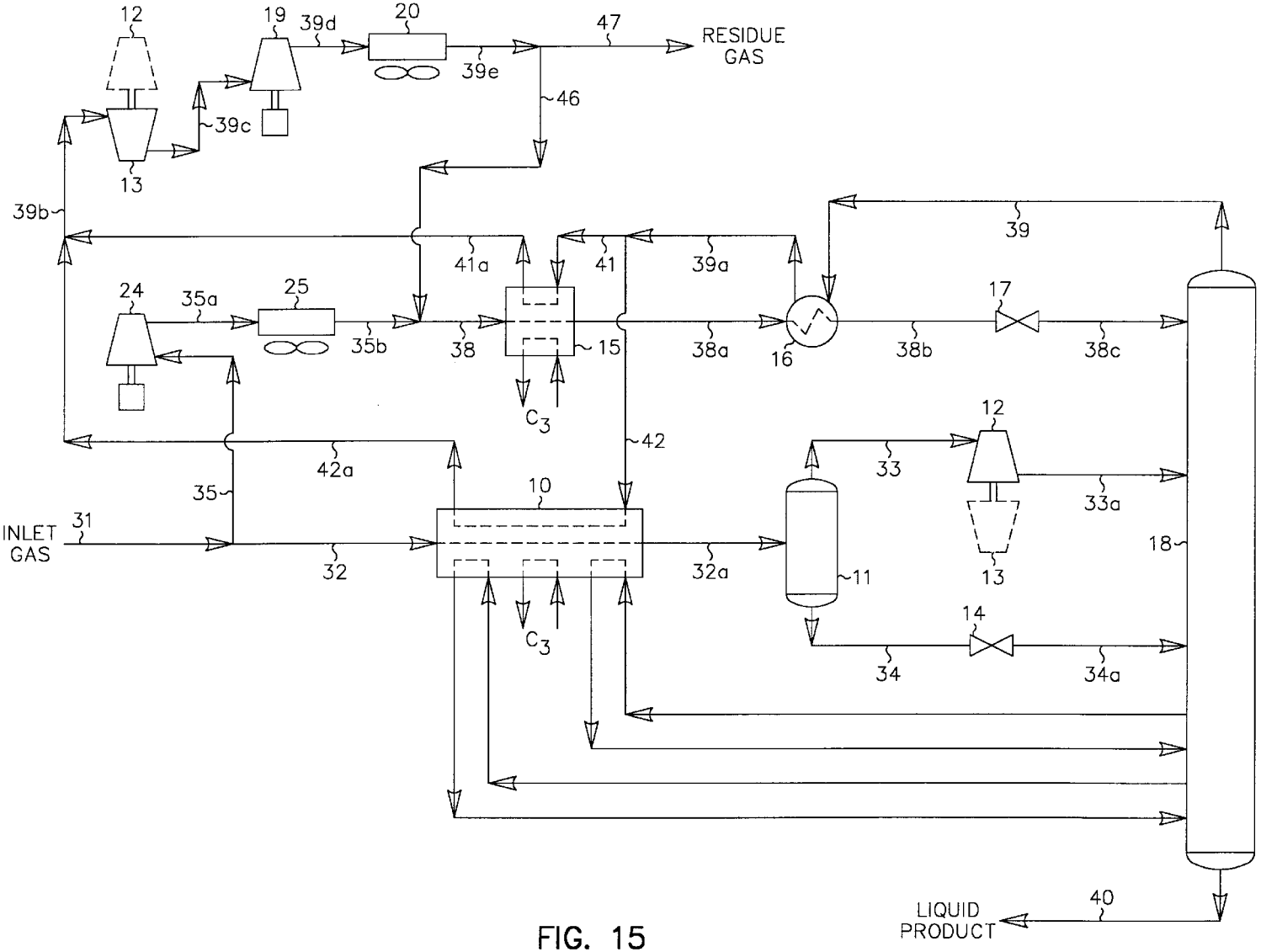
Figure 16:
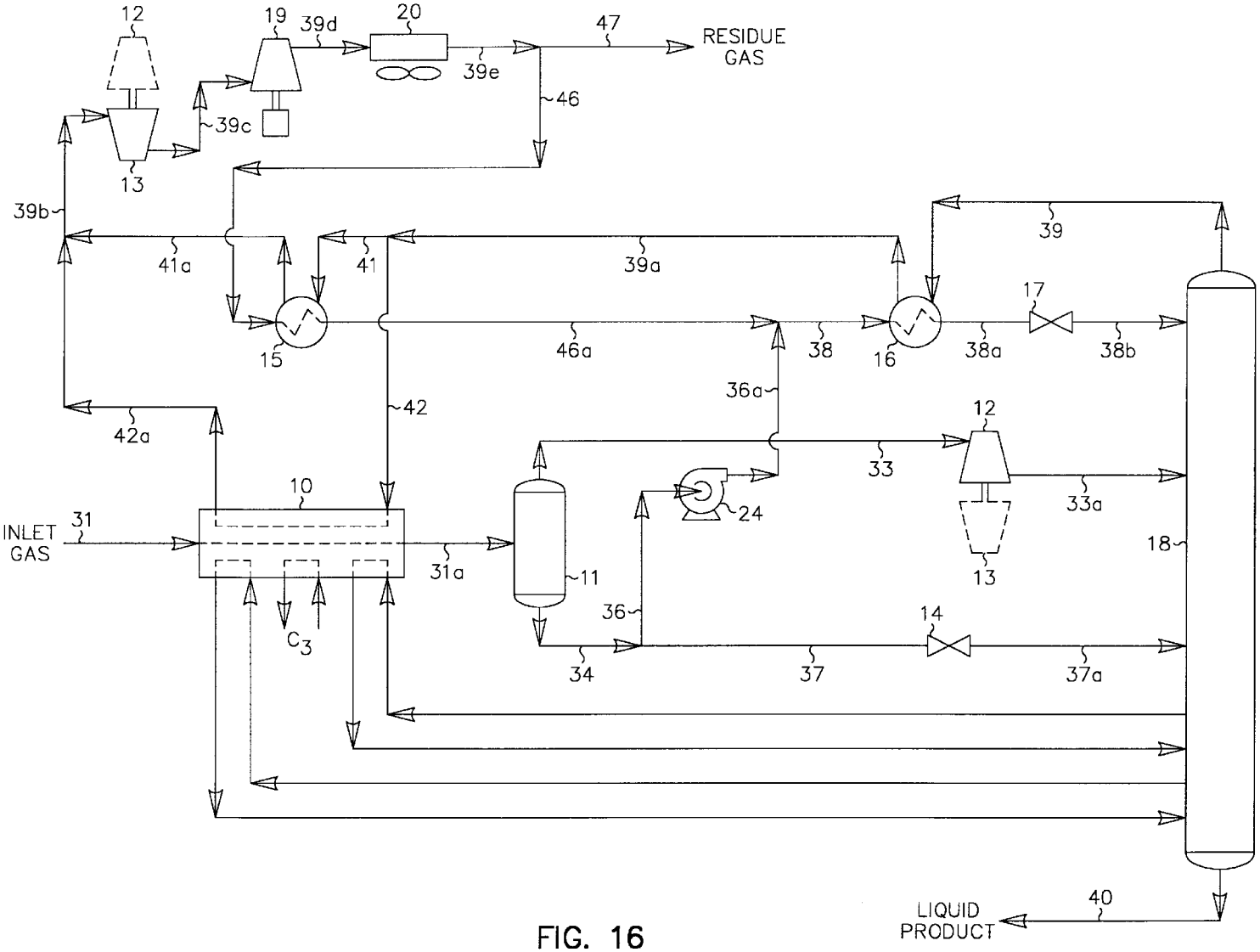

The examples presented heretofore have all contemplated use of the present invention when the pressures of the feed gas and the residue gas are substantially the same. In situations where this is not the case, however, boosting of the lower pressure stream can be employed in accordance with the present invention. Some of the alternative means of applying the present invention in these situations are illustrated in FIGS. 14 through 16, showing boosting of the recycle gas, the feed gas, and the condensed liquids, respectively.

In accordance with this invention, the use of external refrigeration to supplement the cooling available to the feed gas from other process streams may be unnecessary, particularly in the case of a feed gas leaner than that used in Example 1. The use and distribution of demethanizer liquids for process heat exchange, and the particular arrangement of heat exchangers for feed gas cooling must be evaluated for each particular application, as well as the choice of process streams for specific heat exchange services.

Figure 17:
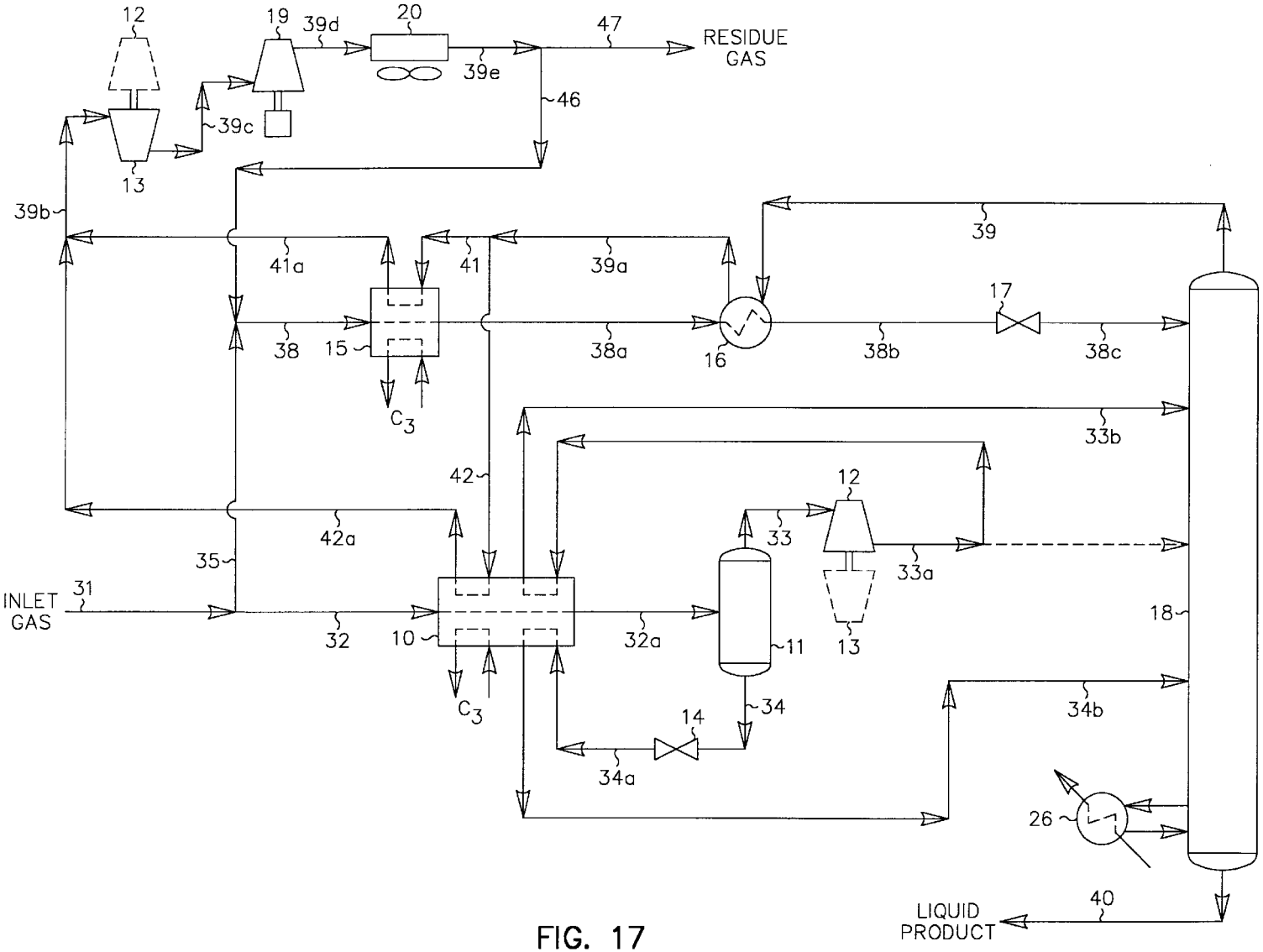

The high pressure liquid in FIG. 3 (stream 34) and the first portion of high pressure liquid in FIG. 5 (stream 37) may be used for feed gas cooling or other heat exchange service before or after the expansion step prior to flowing to the demethanizer. As depicted in FIG. 17, the work expanded stream 33*a* may also be used for feed gas cooling or other heat exchange service prior to flowing to the column.

The process of the present invention is also applicable for processing gas streams when it is desirable to recover only the $C_3$ components and heavier hydrocarbon components (rejection of $C_2$ components and lighter components to the residue gas). Because of the warmer process operating conditions associated with propane recovery (ethane rejection) operation, the feed gas cooling scheme is usually different than for the ethane recovery cases illustrated in FIGS. 3, 5, 7, and 9 through 16. FIG. 17 illustrates a typical application of the present invention when recovery of only the $C_3$ components and heavier hydrocarbon components is desired. When operating as a deethanizer (ethane rejection), the tower reboiler temperatures are significantly warmer than when operating as a demethanizer (ethane recovery). Generally this makes it impossible to reboil the tower using plant feed gas as is typically done for ethane recovery operation. Therefore, an external source for reboil heat is normally employed. For example, a portion of compressed residue gas (stream 39*d*) can sometimes be used to provide the necessary reboil heat. In some instances, a portion of the liquid downflow from the upper, colder section of the tower can be withdrawn and used for feed gas cooling in exchanger 10 and then returned to the tower in a lower, warmer section of the tower, maximizing heat recovery from the tower and minimizing external heat requirements.

It will also be recognized that the relative amount of feed found in each branch of the column feed streams will depend on several factors, including gas pressure, feed gas composition, the amount of heat which can economically be extracted from the feed, and the quantity of horsepower available. More feed to the top of the column may increase recovery while decreasing power recovered from the expansion machine thereby increasing the recompression horsepower requirements. Increasing feed lower in the column reduces the horsepower consumption but may also reduce product recovery. The mid-column feed positions depicted in FIGS. 3, 5, and 7 are the preferred feed locations for the process operating conditions described. However, the relative locations of the mid-column feeds may vary depending on inlet composition or other factors such as desired recovery levels and amount of liquid formed during feed gas cooling. FIGS. 3, 5, and 7 are the preferred embodiments for the compositions and pressure conditions shown. Although individual stream expansion is depicted in particular expansion devices, alternative expansion means may be employed where appropriate. For example, conditions may warrant work expansion of the substantially condensed stream (38*b* in FIGS. 3 and 7, 38*a* in FIG. 5).

While there have been described what are believed to be preferred embodiments of the invention, those skilled in the art will recognize that other and further modifications may be made thereto, e.g. to adapt the invention to various conditions, types of feed or other requirements without departing from the spirit of the present invention as defined by the following claims.

We claim:

1. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein prior to cooling, said gas is divided into gaseous first and second streams; and (1) a distillation stream is withdrawn from an upper region of a fractionation tower and is warmed;

(2) said warmed distillation stream is compressed to higher pressure and thereafter divided into said volatile residue gas fraction and a compressed recycle stream;

(3) said compressed recycle stream is combined with said gaseous first stream to form a combined stream;

(4) said combined stream is cooled to condense substantially all of it;

(5) said substantially condensed combined stream is expanded to said lower pressure and supplied to said fractionation tower at a top feed position;

(6) said gaseous second stream is cooled under pressure sufficiently to partially condense it;

(7) said partially condensed second stream is separated thereby to provide a vapor stream and a condensed stream;

(8) said vapor stream is expanded to said lower pressure and supplied at a first mid-column feed position to a distillation column in a lower region of said fractionation tower;

(9) at least a portion of said condensed stream is expanded to said lower pressure and is supplied to said distillation column at a second mid-column feed position; and

(10) the quantity and pressure of said combined stream and the quantities and temperatures of said feed streams to the column are effective to maintain tower overhead temperature at a temperature whereby the major portions of the components in said relatively less volatile fraction are recovered.

2. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and a condensed stream;

(2) a distillation stream is withdrawn from an upper region of a fractionation tower and is warmed;

(3) said warmed distillation stream is compressed to higher pressure and thereafter divided into said volatile residue gas fraction and a compressed recycle stream;

(4) said compressed recycle stream is combined with at least a portion of said condensed stream to form a combined stream;

(5) said combined stream is cooled to condense substantially all of it;

(6) said substantially condensed combined stream is expanded to said lower pressure and supplied to said fractionation tower at a top feed position;

(7) said vapor stream is expanded to said lower pressure and supplied at a mid-column feed position to a distillation column in a lower region of said fractionation tower;

(8) the quantity and pressure of said combined stream and the quantities and temperatures of said feed streams to the column are effective to maintain tower overhead temperature at a temperature whereby the major portions of the components in said relatively less volatile fraction are recovered.

3. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein following cooling, said cooled stream is divided into first and second streams; and (1) a distillation stream is withdrawn from an upper region of a fractionation tower and is warmed;

(2) said warmed distillation stream is compressed to higher pressure and thereafter divided into said volatile residue gas fraction and a compressed recycle stream;

(3) said compressed recycle stream is combined with said first stream to form a combined stream;

(4) said combined stream is cooled to condense substantially all of it;

(5) said substantially condensed combined stream is expanded to said lower pressure and supplied to said fractionation tower at a top feed position;

(6) said second stream is expanded to said lower pressure and supplied at a mid-column feed position to a distillation column in a lower region of said fractionation tower; and (7) the quantity and pressure of said combined stream and the quantities and temperatures of said feed streams to the column are effective to maintain tower overhead temperature at a temperature whereby the major portions of the components in said relatively less volatile fraction are recovered.

4. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) a distillation stream is withdrawn from an upper region of a fractionation tower and is warmed;

(4) said warmed distillation stream is compressed to higher pressure and thereafter divided into said volatile residue gas fraction and a compressed recycle stream;

(5) said compressed recycle stream is combined with said gaseous first stream to form a combined stream;

(6) said combined stream is cooled to condense substantially all of it;

(7) said substantially condensed combined stream is expanded to said lower pressure and supplied to said fractionation tower at a top feed position;

(8) said gaseous second stream is expanded to said lower pressure and supplied at a first mid-column feed position to a distillation column in a lower region of said fractionation tower;

(9) at least a portion of said condensed stream is expanded to said lower pressure and is supplied to said distillation column at a second mid-column feed position; and

(10) the quantity and pressure of said combined stream and the quantities and temperatures of said feed streams to the column are effective to maintain tower overhead temperature at a temperature whereby the major portions of the components in said relatively less volatile fraction are recovered.

5. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and a condensed stream;

(2) said vapor stream is thereafter divided into gaseous first and second streams;

(3) a distillation stream is withdrawn from an upper region of a fractionation tower and is warmed;

(4) said warmed distillation stream is compressed to higher pressure and thereafter divided into said volatile residue gas fraction and a compressed recycle stream;

(5) said compressed recycle stream is combined with said gaseous first stream and at least a portion of said condensed stream to form a combined stream;

(6) said combined stream is cooled to condense substantially all of it;

(7) said substantially condensed combined stream is expanded to said lower pressure and supplied to said fractionation tower at a top feed position;

(8) said gaseous second stream is expanded to said lower pressure and supplied at a mid-column feed position to a distillation column in a lower region of said fractionation tower;

(9) the quantity and pressure of said combined stream and the quantities and temperatures of said feed streams to the column are effective to maintain tower overhead temperature at a temperature whereby the major portions of the components in said relatively less volatile fraction are recovered.

6. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein prior to cooling, said gas is divided into gaseous first and second streams; and (1) a distillation stream is withdrawn from an upper region of a fractionation tower and is warmed;

(2) said warmed distillation stream is compressed to higher pressure and thereafter divided into said volatile residue gas fraction and a compressed recycle stream;

(3) said compressed recycle stream is combined with said gaseous first stream to form a combined stream;

(4) said combined stream is cooled to condense substantially all of it;

(5) said substantially condensed combined stream is expanded to said lower pressure and supplied to said fractionation tower at a top feed position;

(6) said gaseous second stream is cooled under pressure and then expanded to said lower pressure and supplied at a mid-column feed position to a distillation column in a lower region of said fractionation tower; and (7) the quantity and pressure of said combined stream and the quantities and temperatures of said feed streams to the column are effective to maintain tower overhead temperature at a temperature whereby the major portions of the components in said relatively less volatile fraction are recovered.

7. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is fractionated at said lower pressure whereby the components of said relatively less volatile fraction are recovered;

the improvement wherein following cooling, said cooled stream is divided into first and second streams; and (1) a distillation stream is withdrawn from an upper region of a fractionation tower and is warmed;

(2) said warmed distillation stream is compressed to higher pressure and thereafter divided into said volatile residue gas fraction and a compressed recycle stream;

(3) said compressed recycle stream is combined with said first stream to form a combined stream;

(4) said combined stream is cooled to condense substantially all of it;

(5) said substantially condensed combined stream is expanded to said lower pressure and supplied to said fractionation tower at a top feed position;

(6) said second stream is cooled sufficiently to partially condense it;

(7) said partially condensed second stream is separated thereby to provide a vapor stream and a condensed stream;

(8) said vapor stream is expanded to said lower pressure and supplied at a first mid-column feed position to a distillation column in a lower region of said fractionation tower;

(9) at least a portion of said condensed stream is expanded to said lower pressure and is supplied to said distillation column at a second mid-column feed position; and

(10) the quantity and pressure of said combined stream and the quantities and temperatures of said feed streams to the column are effective to maintain tower overhead temperature at a temperature whereby the major portions of the components in said relatively less volatile fraction are recovered.

8. The improvement according to claims 1, 2, 3, 4, 5, 6 or 7 wherein (a) said warmed distillation stream is divided into said volatile residue gas fraction and a recycle stream prior to compression; and (b) said recycle stream is thereafter compressed to form said compressed recycle stream.

9. The improvement according to claims 1, 2, 3, 4, 5, 6 or 7 wherein (a) said distillation stream is divided into said volatile residue gas fraction and a recycle stream prior to heating; and (b) said recycle stream is thereafter compressed to form said compressed recycle stream.

10. The improvement according to claims 2 or 5 wherein at least a portion of said condensed stream is expanded to said lower pressure and then supplied to said distillation column at a second mid-column feed position.

11. The improvement according to claim 10 wherein (a) said warmed distillation stream is divided into said volatile residue gas fraction and a recycle stream prior to compression; and (b) said recycle stream is thereafter compressed to form said compressed recycle stream.

12. The improvement according to claim 10 wherein (a) said distillation stream is divided into said volatile residue gas fraction and a recycle stream prior to heating; and (b) said recycle stream is thereafter compressed to form said compressed recycle stream.

13. The improvement according to claims 1, 4 or 7 wherein (a) said condensed stream is cooled and then divided into first and second liquid portions prior to said expansion;

(b) said first liquid portion is expanded to said lower pressure and supplied to said column at a mid-column feed position; and (c) said second liquid portion is expanded to said lower pressure and supplied to said column at a higher mid-column feed position.

14. The improvement according to claim 13 wherein (a) said warmed distillation stream is divided into said volatile residue gas fraction and a recycle stream prior to compression; and (b) said recycle stream is thereafter compressed to form said compressed recycle stream.

15. The improvement according to claim 13 wherein (a) said distillation stream is divided into said volatile residue gas fraction and a recycle stream prior to heating; and (b) said recycle stream is thereafter compressed to form said compressed recycle stream.

16. The improvement according to claim 13 wherein said expanded first liquid portion is heated prior to being supplied to said distillation column.

17. The improvement according to claim 16 wherein (a) said warmed distillation stream is divided into said volatile residue gas fraction and a recycle stream prior to compression; and (b) said recycle stream is thereafter compressed to form said compressed recycle stream.

18. The improvement according to claim 16 wherein (a) said distillation stream is divided into said volatile residue gas fraction and a recycle stream prior to heating; and (b) said recycle stream is thereafter compressed to form said compressed recycle stream.

19. The improvement according to claim 13 wherein said first liquid portion is expanded, directed in heat exchange relation with said condensed stream and is then supplied to said column at a mid-column feed position.

20. The improvement according to claim 19 wherein (a) said warmed distillation stream is divided into said volatile residue gas fraction and a recycle stream prior to compression; and (b) said recycle stream is thereafter compressed to form said compressed recycle stream.

21. The improvement according to claim 19 wherein (a) said distillation stream is divided into said volatile residue gas fraction and a recycle stream prior to heating; and (b) said recycle stream is thereafter compressed to form said compressed recycle stream.

22. The improvement according to claims 1, 2 or 7 wherein at least a portion of said vapor stream is heated after expansion to said lower pressure.

23. The improvement according to claim 22 wherein (a) said warmed distillation stream is divided into said volatile residue gas fraction and a recycle stream prior to compression; and (b) said recycle stream is thereafter compressed to form said compressed recycle stream.

24. The improvement according to claim 22 wherein (a) said distillation stream is divided into said volatile residue gas fraction and a recycle stream prior to heating; and (b) said recycle stream is thereafter compressed to form said compressed recycle stream.

25. The improvement according to claims 3, 4, 5 or 6 wherein at least a portion of said second stream is heated after expansion to said lower pressure.

26. The improvement according to claim 25 wherein (a) said warmed distillation stream is divided into said volatile residue gas fraction and a recycle stream prior to compression; and (b) said recycle stream is thereafter compressed to form said compressed recycle stream.

27. The improvement according to claim 25 wherein (a) said distillation stream is divided into said volatile residue gas fraction and a recycle stream prior to heating; and (b) said recycle stream is thereafter compressed to form said compressed recycle stream.

28. The improvement according to claims 1, 4 or 7 wherein at least a portion of said expanded condensed stream is heated prior to being supplied to said distillation column.

29. The improvement according to claim 28 wherein (a) said warmed distillation stream is divided into said volatile residue gas fraction and a recycle stream prior to compression; and (b) said recycle stream is thereafter compressed to form said compressed recycle stream.

30. The improvement according to claim 28 wherein (a) said distillation stream is divided into said volatile residue gas fraction and a recycle stream prior to heating; and (b) said recycle stream is thereafter compressed to form said compressed recycle stream.

31. The improvement according to claims 2 or 5 wherein at least a portion of said condensed stream is expanded to said lower pressure, heated and then supplied to said distillation column at a second mid-column feed position.

32. The improvement according to claim 31 wherein (a) said warmed distillation stream is divided into said volatile residue gas fraction and a recycle stream prior to compression; and (b) said recycle stream is thereafter compressed to form said compressed recycle stream.

33. The improvement according to claim 31 wherein (a) said distillation stream is divided into said volatile residue gas fraction and a recycle stream prior to heating; and (b) said recycle stream is thereafter compressed to form said compressed recycle stream.

34. The improvement according to claims 1 or 7 wherein at least portions of said expanded vapor stream and said expanded condensed stream are combined to form a second combined stream, whereupon said second combined stream is supplied to said column at a mid-column feed position.

35. The improvement according to claim 34 wherein (a) said warmed distillation stream is divided into said volatile residue gas fraction and a recycle stream prior to compression; and (b) said recycle stream is thereafter compressed to form said compressed recycle stream.

36. The improvement according to claim 34 wherein (a) said distillation stream is divided into said volatile residue gas fraction and a recycle stream prior to heating; and (b) said recycle stream is thereafter compressed to form said compressed recycle stream.

37. The improvement according to claim 2 wherein at least a portion of said condensed stream is expanded to said lower pressure and combined with at least a portion of said expanded vapor stream to form a second combined stream, whereupon said second combined stream is supplied to said column at a mid-column feed position.

38. The improvement according to claim 37 wherein (a) said warmed distillation stream is divided into said volatile residue gas fraction and a recycle stream prior to compression; and (b) said recycle stream is thereafter compressed to form said compressed recycle stream.

39. The improvement according to claim 37 wherein (a) said distillation stream is divided into said volatile residue gas fraction and a recycle stream prior to heating; and (b) said recycle stream is thereafter compressed to form said compressed recycle stream.

40. The improvement according to claim 4 wherein at least portions of said expanded second stream and said expanded condensed stream are combined to form a second combined stream, whereupon said second combined stream is supplied to said column at a mid-column feed position.

41. The improvement according to claim 40 wherein (a) said warmed distillation stream is divided into said volatile residue gas fraction and a recycle stream prior to compression; and (b) said recycle stream is thereafter compressed to form said compressed recycle stream.

42. The improvement according to claim 40 wherein (a) said distillation stream is divided into said volatile residue gas fraction and a recycle stream prior to heating; and (b) said recycle stream is thereafter compressed to form said compressed recycle stream.

43. The improvement according to claim 5 wherein at least a portion of said condensed stream is expanded to said lower pressure and combined with at least a portion of said expanded second stream to form a second combined stream, whereupon said second combined stream is supplied to said column at a mid-column feed position.

44. The improvement according to claim 43 wherein (a) said warmed distillation stream is divided into said volatile residue gas fraction and a recycle stream prior to compression; and (b) said recycle stream is thereafter compressed to form said compressed recycle stream.

45. The improvement according to claim 43 wherein (a) said distillation stream is divided into said volatile residue gas fraction and a recycle stream prior to heating; and (b) said recycle stream is thereafter compressed to form said compressed recycle stream.

46. The improvement according to claims 1 or 7 wherein (a) said condensed stream is cooled and then divided into first and second liquid portions prior to said expansion;

(b) said first liquid portion is expanded to said lower pressure and supplied to said column at a mid-column feed position;

(c) said second liquid portion is expanded to said lower pressure and combined with at least a portion of said expanded vapor stream to form a second combined stream; and (d) said second combined stream is supplied to said column at a higher mid-column feed position.

47. The improvement according to claim 46 wherein (a) said warmed distillation stream is divided into said volatile residue gas fraction and a recycle stream prior to compression; and (b) said recycle stream is thereafter compressed to form said compressed recycle stream.

48. The improvement according to claim 46 wherein (a) said distillation stream is divided into said volatile residue gas fraction and a recycle stream prior to heating; and (b) said recycle stream is thereafter compressed to form said compressed recycle stream.

49. The improvement according to claim 46 wherein said expanded first liquid portion is heated prior to being supplied to said distillation column.

50. The improvement according to claim 49 wherein (a) said warmed distillation stream is divided into said volatile residue gas fraction and a recycle stream prior to compression; and (b) said recycle stream is thereafter compressed to form said compressed recycle stream.

51. The improvement according to claim 49 wherein (a) said distillation stream is divided into said volatile residue gas fraction and a recycle stream prior to heating; and (b) said recycle stream is thereafter compressed to form said compressed recycle stream.

52. The improvement according to claim 46 wherein said first liquid portion is expanded, directed in heat exchange relation with said condensed stream and is then supplied to said column at a mid-column feed position.

53. The improvement according to claim 52 wherein (a) said warmed distillation stream is divided into said volatile residue gas fraction and a recycle stream prior to compression; and (b) said recycle stream is thereafter compressed to form said compressed recycle stream.

54. The improvement according to claim 52 wherein (a) said distillation stream is divided into said volatile residue gas fraction and a recycle stream prior to heating; and (b) said recycle stream is thereafter compressed to form said compressed recycle stream.

55. The improvement according to claim 4 wherein (a) said condensed stream is cooled and then divided into first and second liquid portions prior to said expansion;

(b) said first liquid portion is expanded to said lower pressure and supplied to said column at a mid-column feed position;

(c) said second liquid portion is expanded to said lower pressure and combined with at least a portion of said expanded second stream to form a second combined stream; and (d) said second combined stream is supplied to said column at a higher mid-column feed position.

56. The improvement according to claim 55 wherein (a) said warmed distillation stream is divided into said volatile residue gas fraction and a recycle stream prior to compression; and (b) said recycle stream is thereafter compressed to form said compressed recycle stream.

57. The improvement according to claim 55 wherein (a) said distillation stream is divided into said volatile residue gas fraction and a recycle stream prior to heating; and (b) said recycle stream is thereafter compressed to form said compressed recycle stream.

58. The improvement according to claim 55 wherein said expanded first liquid portion is heated prior to being supplied to said distillation column.

59. The improvement according to claim 58 wherein (a) said warmed distillation stream is divided into said volatile residue gas fraction and a recycle stream prior to compression; and (b) said recycle stream is thereafter compressed to form said compressed recycle stream.

60. The improvement according to claim 58 wherein (a) said distillation stream is divided into said volatile residue gas fraction and a recycle stream prior to heating; and (b) said recycle stream is thereafter compressed to form said compressed recycle stream.

61. The improvement according to claim 55 wherein said first liquid portion is expanded, directed in heat exchange relation with said condensed stream and is then supplied to said column at a mid-column feed position.

62. The improvement according to claim 61 wherein (a) said warmed distillation stream is divided into said volatile residue gas fraction and a recycle stream prior to compression; and (b) said recycle stream is thereafter compressed to form said compressed recycle stream.

63. The improvement according to claim 61 wherein (a) said distillation stream is divided into said volatile residue gas fraction and a recycle stream prior to heating; and (b) said recycle stream is thereafter compressed to form said compressed recycle stream.

64. In an apparatus for the separation of a gas containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means prior to said first cooling means to divide said feed gas into a first gaseous stream and a second gaseous stream;

(2) heating means connected to said fractionation tower to receive a distillation stream which rises in the fractionation tower and to heat it;

(3) compressing means connected to said heating means to receive said heated distillation stream and to compress it;

(4) second dividing means connected to said compressing means to receive said heated compressed distillation stream and to divide it into said volatile residue gas fraction and a compressed recycle stream;

(5) combining means connected to combine said compressed recycle stream and said first gaseous stream into a combined stream;

(6) second cooling means connected to said combining means to receive said combined stream and to cool it sufficiently to substantially condense it;

(7) second expansion means connected to said second cooling means to receive said substantially condensed combined stream and to expand it to said lower pressure; said second expansion means being further connected to said fractionation tower to supply said expanded condensed combined stream to the tower at a top feed position;

(8) said first cooling means being connected to said first dividing means to receive said second gaseous stream and to cool it under pressure sufficiently to partially condense it;

(9) separation means connected to said first cooling means to receive said partially condensed second stream and to separate it into a vapor and a condensed stream;

(10) said first expansion means being connected to said separation means to receive said vapor stream and to expand it to said lower pressure; said first expansion means being further connected to a distillation column in a lower region of said fractionation tower to supply said expanded vapor stream to said distillation column at a first mid-column feed position;

(11) third expansion means being connected to said separation means to receive said condensed stream and to expand it to said lower pressure; said third expansion means being further connected to said distillation column to supply said expanded condensed stream to said distillation column at a second mid-column feed position; and

(12) control means adapted to regulate the pressure of said combined stream and the quantities and temperatures of said combined stream, said second stream and said condensed stream to maintain column overhead temperature at a temperature whereby the major portions of the components in said relatively less volatile fraction are recovered.

65. In an apparatus for the separation of a gas containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first cooling means adapted to cool said feed gas under pressure sufficiently to partially condense it;

(2) separation means connected to said first cooling means to receive said partially condensed feed stream and to separate it into a vapor and a condensed stream;

(3) heating means connected to said fractionation tower to receive a distillation stream which rises in the fractionation tower and to heat it;

(4) compressing means connected to said heating means to receive said heated distillation stream and to compress it;

(5) dividing means connected to said compressing means to receive said heated compressed distillation stream and to divide it into said volatile residue gas fraction and a compressed recycle stream;

(6) combining means connected to combine said compressed recycle stream and at least a portion of said condensed stream into a combined stream;

(7) second cooling means connected to said combining means to receive said combined stream and to cool it sufficiently to substantially condense it;

(8) second expansion means connected to said second cooling means to receive said substantially condensed combined stream and to expand it to said lower pressure; said second expansion means being further connected to said fractionation tower to supply said expanded condensed combined stream to the tower at a top feed position;

(9) said first expansion means being connected to said separation means to receive said vapor stream and to expand it to said lower pressure; said first expansion means being further connected to a distillation column in a lower region of said fractionation tower to supply said expanded vapor stream to said distillation column at a mid-column feed position; and

(10) control means adapted to regulate the pressure of said combined stream and the quantities and temperatures of said combined stream and said vapor stream to maintain column overhead temperature at a temperature whereby the major portions of the components in said relatively less volatile fraction are recovered.

66. In an apparatus for the separation of a gas containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means prior to said first cooling means to divide said feed gas into a first gaseous stream and a second gaseous stream;

(2) heating means connected to said fractionation tower to receive a distillation stream which rises in the fractionation tower and to heat it;

(3) compressing means connected to said heating means to receive said heated distillation stream and to compress it;

(4) second dividing means connected to said compressing means to receive said heated compressed distillation stream and to divide it into said volatile residue gas fraction and a compressed recycle stream;

(5) combining means connected to combine said compressed recycle stream and said first gaseous stream into a combined stream;

(6) second cooling means connected to said combining means to receive said combined stream and to cool it sufficiently to substantially condense it;

(7) second expansion means connected to said second cooling means to receive said substantially condensed combined stream and to expand it to said lower pressure; said second expansion means being further connected to said fractionation tower to supply said expanded condensed combined stream to the tower at a top feed position;

(8) said first cooling means being connected to said first dividing means to receive said second gaseous stream and to cool it under pressure;

(9) said first expansion means being connected to said first cooling means to receive said cooled second stream and to expand it to said lower pressure; said first expansion means being further connected to a distillation column in a lower region of said fractionation tower to supply said expanded second stream to said distillation column at a mid-column feed position; and

(10) control means adapted to regulate the pressure of said combined stream and the quantities and temperatures of said combined stream and said second stream to maintain column overhead temperature at a temperature whereby the major portions of the components in said relatively less volatile fraction are recovered.

67. In an apparatus for the separation of a gas containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a fractionation tower connected to said first expansion means to receive said further cooled stream therefrom;

the improvement wherein said apparatus includes (1) first dividing means prior to said first cooling means to divide said feed gas into a first gaseous stream and a second gaseous stream;

(2) heating means connected to said fractionation tower to receive a distillation stream which rises in the fractionation tower and to heat it;

(3) compressing means connected to said heating means to receive said heated distillation stream and to compress it;

(4) second dividing means connected to said compressing means to receive said heated compressed distillation stream and to divide it into said volatile residue gas fraction and a compressed recycle stream;

(5) combining means connected to combine said compressed recycle stream and said first gaseous stream into a combined stream;

(6) second cooling means connected to said combining means to receive said combined stream and to cool it sufficiently to substantially condense it;

(7) second expansion means connected to said second cooling means to receive said substantially condensed combined stream and to expand it to said lower pressure; said second expansion means being further connected to said fractionation tower to supply said expanded condensed combined stream to the tower at a top feed position;

(8) said first cooling means being connected to said first dividing means to receive said second gaseous stream and to cool it under pressure sufficiently to partially condense it;

(9) separation means connected to said first cooling means to receive said partially condensed second stream and to separate it into a vapor and a condensed stream;

(10) said first expansion means being connected to said separation means to receive said vapor stream and to expand it to said lower pressure; said first expansion means being further connected to a distillation column in a lower region of said fractionation tower to supply said expanded vapor stream to said distillation column at a first mid-column feed position;

(11) heat exchange means being connected to said separation means to receive said condensed stream and cool it;

(12) third dividing means connected to said heat exchange means to receive said cooled condensed stream and divide it into a first liquid stream and a second liquid stream;

(13) third expansion means being connected to said third dividing means to receive said first liquid stream and to expand it to said lower pressure; said third expansion means being further connected to said heat exchange means to heat said expanded first liquid stream and thereby supply said cooling to said condensed stream; said heat exchange means being further connected to said distillation column to supply said heated expanded first liquid stream to said distillation column at a second mid-column feed position;

(14) fourth expansion means being connected to said third dividing means to receive said second liquid stream and to expand it to said lower pressure; said fourth expansion means being further connected to said distillation column at an upper mid-column feed position; and

(15) control means adapted to regulate the pressure of said combined stream and the quantities and temperatures of said combined stream, said second stream, said first liquid stream and said second liquid stream to maintain column overhead temperature at a temperature whereby the major portions of the components in said relatively less volatile fraction are recovered.

* * * * *

UNITED STATES PATENT AND TRADEMARK OFFICE

CERTIFICATE OF CORRECTION

PATENT NO. : 5,881,569
DATED : March 16, 1999
INVENTOR(S) : John D. Wilkinson, Hank M. Hudson, and Kyle T. Cuellar It is certified that error appears in the above-identified patent and that said Letters Patent is hereby corrected as shown below:

Item [75] Change "Cueller" to -- Cuellar --.

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*